US008831489B2

(12) United States Patent
Takayanagi

(10) Patent No.: US 8,831,489 B2
(45) Date of Patent: Sep. 9, 2014

(54) ELECTROSTATIC IMAGE FORMING APPARATUS HAVING ELECTRODE FOR SUPPRESSING ELECTRIC DISCHARGE

(75) Inventor: Hiroki Takayanagi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/945,924

(22) Filed: Nov. 15, 2010

(65) Prior Publication Data

US 2011/0116846 A1 May 19, 2011

(30) Foreign Application Priority Data

Nov. 19, 2009 (JP) ..... 2009-264312

(51) Int. Cl.
*G03G 15/01* (2006.01)

(52) U.S. Cl.
USPC ..... 399/302; 399/303

(58) Field of Classification Search
CPC ..... G03G 15/1605; G03G 15/0131; G03G 15/1675; G03G 15/161; G03G 2215/0119
USPC ..... 399/302, 303, 308, 310, 311, 312, 313, 399/297, 296, 314, 390, 66
See application file for complete search history.

(56) References Cited

U.S. PATENT DOCUMENTS

| | | | | |
|---|---|---|---|---|
| 4,931,839 | A | 6/1990 | Tompkins et al. | |
| 4,984,024 | A | 1/1991 | Ohkaji et al. | |
| 5,075,731 | A | 12/1991 | Kamimura et al. | |
| 5,194,902 | A | 3/1993 | Kamimura et al. | |
| 5,268,725 | A | 12/1993 | Koga et al. | |
| 5,461,461 | A | 10/1995 | Harasawa et al. | |
| 5,740,508 | A | 4/1998 | Matsuura et al. | |
| 7,440,720 | B2 | 10/2008 | Takehara | |
| 2006/0127116 | A1 * | 6/2006 | Ogiyama et al. | 399/66 |
| 2006/0170936 | A1 | 8/2006 | Takehara | |
| 2007/0217832 | A1 * | 9/2007 | Oyama et al. | 399/302 |
| 2010/0135703 | A1 * | 6/2010 | Nakamura et al. | 399/313 |

FOREIGN PATENT DOCUMENTS

| | | | | |
|---|---|---|---|---|
| JP | 4-127185 | A | 4/1992 | |
| JP | 05323800 | A * | 12/1993 | G03G 15/16 |
| JP | 06-095536 | A | 4/1994 | |
| JP | 2004-133419 | A | 4/2004 | |
| JP | 2004184984 | A * | 7/2004 | G03G 15/16 |
| JP | 2004-333907 | A | 11/2004 | |

(Continued)

OTHER PUBLICATIONS

Communication—European Search Report, European Patent Appln. No. 10191654.2, European Patent Office, Mar. 21, 2011.

(Continued)

*Primary Examiner* — Billy Lactaoen
(74) *Attorney, Agent, or Firm* — Fitzpatrick, Cella, Harper & Scinto

(57) ABSTRACT

An image forming apparatus includes an image bearing member; an image forming portion for forming a toner image on the image bearing member; an intermediary transfer belt for carrying the toner image transferred from the image bearing member; a transfer belt for carrying and conveying a recording material; an attraction portion for electrostatically attracting the recording material to the transfer belt; a transfer portion for transferring the toner image from the intermediary transfer belt onto the recording material attracted to the transfer belt; and an electrode member, disposed downstream of the attraction portion and upstream of the transfer portion with respect to a movement direction of the transfer belt, being contacted to an inner surface of the transfer belt.

11 Claims, 16 Drawing Sheets

(56) References Cited

FOREIGN PATENT DOCUMENTS

| | | | |
|---|---|---|---|
| JP | 2006-106701 | A | 4/2006 |
| JP | 2007-003634 | A | 1/2007 |
| JP | 2008-186029 | A | 8/2008 |

OTHER PUBLICATIONS

Notification of the First Office Action dated Jun. 26, 2012, in Chinese Application No. 201010553999.4.

Office Action mailed Feb. 10, 2014, in Korean Application No. 10-2010-0114903.

* cited by examiner (a) COMP. EMB. INCLUDING TRANSFER BELT (b) COMP. EMB. INCLUDING ATTRACTION ROLLER (a) IMAGE FORMING PORTION (PRIMARY TRANSFER PORTION)

(b) ATTRACTION ROLLER (c) POTENTIAL CHANGE OF CHARGED OBJECT (d) RELATIONSHIP BETWEEN DISTANCE AND POTENTIAL (a) FRONT VIEW (b) PLAN VIEW (a) NO REGULATING PLATE (b) WITH REGULATING PLATE (a) FRONT VIEW (b) PLAN VIEW (a) NO REGULATING PLATE (b) WITH REGULATING PLATE

ELECTROSTATIC IMAGE FORMING APPARATUS HAVING ELECTRODE FOR SUPPRESSING ELECTRIC DISCHARGE

FIELD OF THE INVENTION AND RELATED ART

The present invention relates to an image forming apparatus in which a toner image is transferred onto a recording material electrostatically attracted to a transfer belt and specifically relates to a structure for suppressing electric discharge and toner scattering on an upstream side of a transfer portion of the toner image.

The image forming apparatus of a transfer belt type in which a plurality of image forming portions different in developing color is disposed along a transfer belt has been put into practical use (Japanese Laid-Open Patent Application (JP-A) 2007-003634). The image forming apparatus of an intermediary transfer and transfer belt type in which the toner images formed by the image forming portions are primary-transferred onto an intermediary transfer belt and then are secondary-transferred from the intermediary transfer belt onto the recording material carried on the transfer belt has also been put into practical use (JP-A 2004-133419).

In either case, in the image forming apparatus of the transfer belt type, an attraction portion for carrying the recording material on the transfer belt with charging of the transfer belt is provided on an upstream side of the toner image transfer portion. In the image forming apparatus of the transfer belt type, the toner image is transferred from a photosensitive member or an intermediary transfer member in a state in which the recording material is attracted to the transfer belt, so that the recording material can be separated easily on a downstream side of the toner image transfer portion.

As shown in FIG. 3(*b*), in the case where the recording material is electrostatically attracted to a transfer belt 15 on the upstream side of a secondary transfer portion T2 of the toner image, it was found that electric discharge and toner scattering occurred at the secondary transfer portion T2 and an image quality was liable to lower. When the electric discharge occurs, white spot-like toner falling-off occurs on an output image. When the toner scattering occurs, a line image or a character image blurs.

Then, when an electric potential at each of positions along the transfer belt 15 from the attract portion to the transfer portion was measured, as shown in FIGS. 5(*a*) to 5(*d*), it was found that the potential unstably fluctuated at each position of the transfer belt 15. Further, it was also found that the potential of the transfer belt 15 entering the secondary transfer portion T2 changed depending on ambient temperature and humidity, the type of the recording material, a rotational speed of the transfer belt 15, and the like.

Further, when a similar measurement was performed also with respect to an intermediary transfer belt 6 for carrying the toner image, it was found that the potential of the intermediary transfer belt 6 entering the secondary transfer portion T2 changed depending on a size of the toner image, the rotational speed, and the like. Further, it was found that the electric discharge and the toner scattering occurred when particular conditions on the transfer belt 15 side and the intermediary transfer belt 6 side conspired.

SUMMARY OF THE INVENTION

A principal object of the present invention is to provide an image forming apparatus which has improved in potential stability of a recording material entering a transfer portion while being carried on a transfer belt.

According to an aspect of the present invention, there is provided an image forming apparatus comprising:

an image bearing member;

image forming means for forming a toner image on the image bearing member;

an intermediary transfer belt for carrying the toner image transferred from the image bearing member;

a transfer belt for carrying and conveying a recording material;

an attraction portion for electrostatically attracting the recording material to the transfer belt;

a transfer portion for transferring the toner image from the intermediary transfer belt onto the recording material attracted to the transfer belt; and an electrode member, disposed downstream of the attraction portion and upstream of the transfer portion with respect to a movement direction of the transfer belt, being contacted to an inner surface of the transfer belt.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, embodiments of the present invention will be described in detail with reference to the drawings. The present invention can also be carried out in other embodiments in which a part or all of constitution of the following embodiments are replaced with alternative constitutions so long as a sheet-like electrode is disposed on an inner (inside) surface of a belt member located upstream of a transfer portion.

Therefore, the present invention can be carried out irrespective of a difference among a tandem type, a one-drum type and an intermediary transfer type so long as the image forming apparatus in which a toner image is transferred onto a recording material carried on a transfer belt. In the following embodiments, a principal portion relating to formation and transfer of a toner image will be described but the present invention can be carried out in various fields of a printer, various printing machines, a copying machine, a facsimile machine, a multi-function machine, and the like by adding necessary equipment, device and casing structure.

(Image Forming Apparatus)

Figure 1:
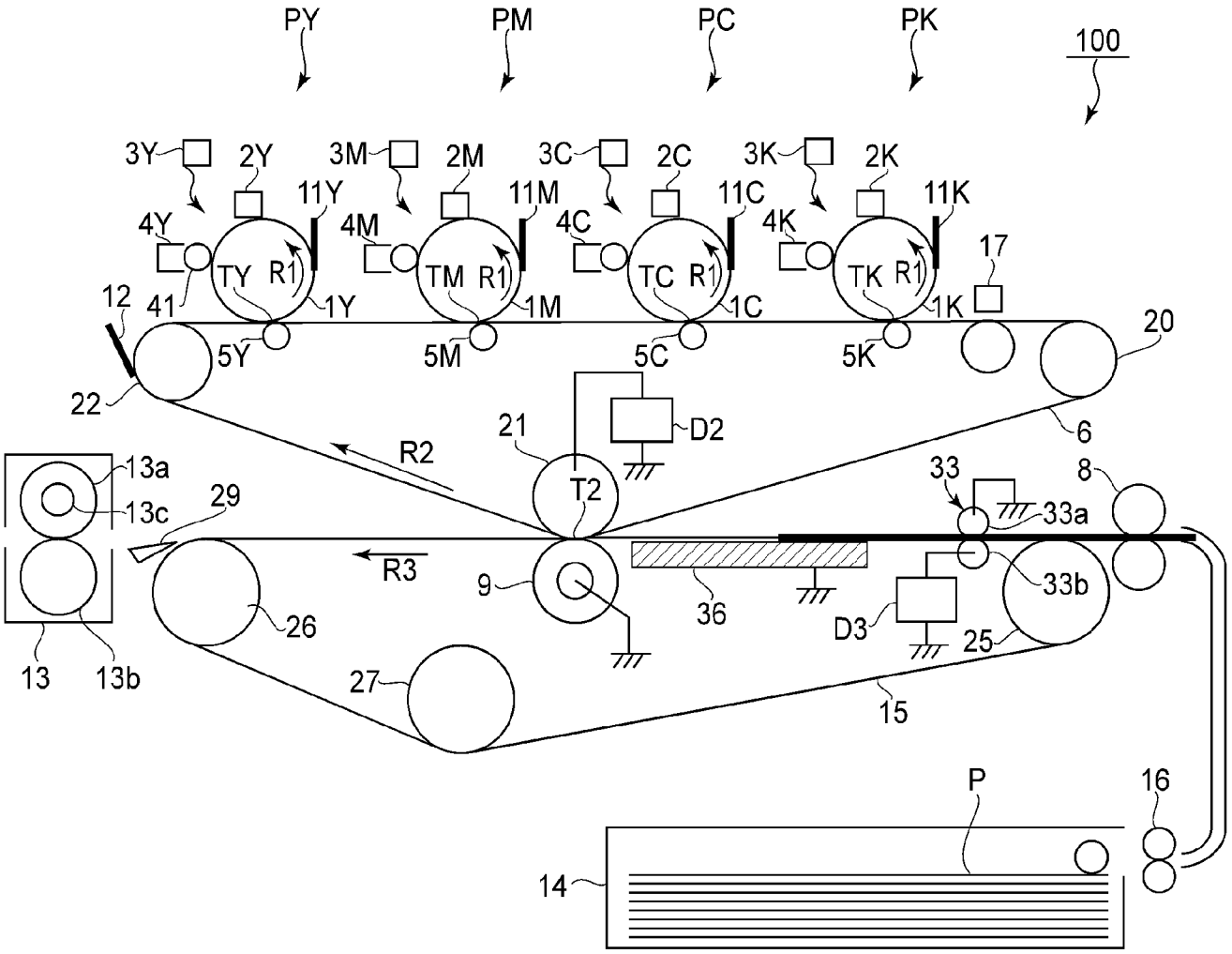
FIG. 1 is an illustration of a structure of an image forming apparatus in an embodiment.
Figure 2:
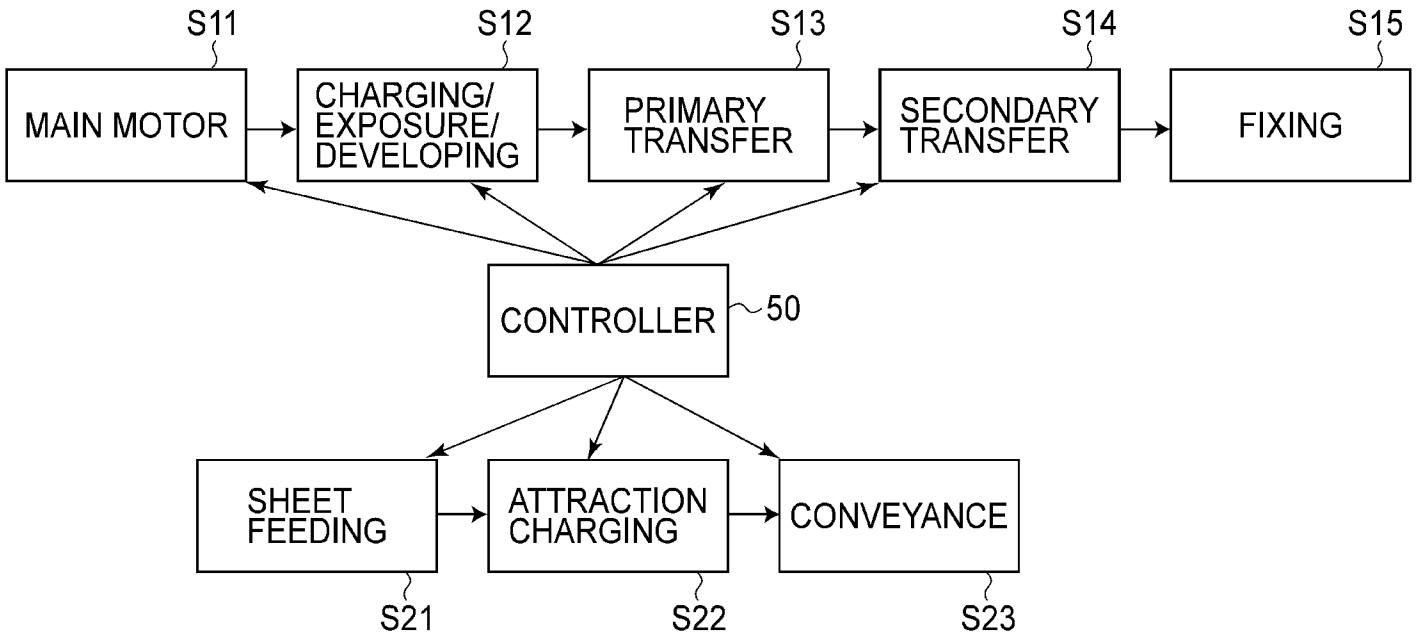
FIG. 2 is an illustration of control of the image forming apparatus.

FIG. 1 is an illustration of a constitution of the image forming apparatus. FIG. 2 is an illustration of control of the image forming apparatus.

As shown in FIG. 1, an image forming apparatus 100 is a full-color printer of the tandem type and of the intermediary transfer type in which image forming portions PY, PM, PC and PK for yellow, magenta, cyan and black, respectively are sequentially arranged along an intermediary transfer belt 6.

In the image forming apparatus PY, a yellow toner image is formed on a photosensitive drum 17Y as an example of a photosensitive member, and is primary-transferred onto the intermediary transfer belt 6. In the image forming portion PM, a magenta toner image is formed on a photosensitive drum 17M, and is primary-transferred superposedly onto the yellow toner image on the intermediary transfer belt 6. In the image forming portions PC and PK, cyan and black toner images are formed on photosensitive drums 17C and 17K, respectively, and are sequentially primary-transferred supposedly onto the intermediary transfer belt 6 in a similar manner.

Four color toner images transferred onto the intermediary transfer belt 6 are conveyed to a secondary transfer portion T2, in which the toner images are secondary-transferred collectively onto the recording material P carried on a transfer belt 15. Then, the recording material P on which the toner images are secondary-transferred are subjected to heat and pressure in a fixing device 13, so that the toner image are fixed on the surface of the recording material P and then the recording material P is discharged out of the apparatus 100.

The intermediary transfer belt 6 is extended around and supported by a driving roller 2 which is rotationally driven, a tension roller 22 for controlling tension of the intermediary transfer belt 6 at a constant level, and an opposite roller 21, and is rotated in the direction indicating by an arrow R2 at a process speed of 250 mm/sec to 300 mm/sec.

As shown in FIG. 2, a control portion 50 effects conveyance of the recording material P (S21 to S23) in parallel with the image formation (S11 to S15) described above.

The recording material P drawn from a recording material cassette 10 on the basis of a start signal is separated one by one by separation rollers 16, and is sent to registration rollers 8 by the separation rollers 16. The registration rollers 12 receive the recording material P in a rest state and keep the recording material P on standby, and then send the recording material P to the secondary transfer portion T2 by timing the recording material P to the toner images on the intermediary transfer belt 6 (S21).

The recording material P conveyed by the registration rollers 8 is attracted to the transfer belt 15 by being sandwiched between the transfer belt 15 and an attraction roller 33 to which an attraction bias is applied (S22). The registration rollers 8 send the recording material P so as to be synchronized with timing when a leading end portion of the recording material P reaches the transfer portion T2 (S23).

A belt cleaning device 12 rubs the intermediary transfer belt 6 with a cleaning blade to collect transfer residual toner which has passed through the transfer portion T2 without being transferred onto the recording material P and remains on the intermediary transfer belt 6.

The fixing device 13 is a heat roller fixing device which rotates a fixing roller 13*a* and a pressing roller 13*b* while press-contacting these rollers each other. Inside the fixing device, a halogen lamp heater 13*c* is disposed. The fixing device 13 controls an applied voltage to the halogen lamp heater 13*c* to effect temperature control by which the surface of the fixing roller 13*a* is kept at a predetermined fixing temperature. The toners of the respective color toner images on the recording material P are melt-mixed each other during a process in which the recording material P is introduced into a press-contact portion between the fixing roller 13*a* and the pressing roller 13*b* and is nip-conveyed in the press-contact portion, so that a full-color image is fixed on the recording material P.

The image forming portions PY, PM, PC and PK are substantially the same in structure except that colors of the toners used in developing devices 4Y, 4M, 4C and 4K are yellow, magenta, cyan and black, i.e., different from each other. Thus, the image forming portion PY will be described below. As for the description of the other image forming portions PM, PC and PK, the suffix Y of constituent members of the image forming portion PY shall be replaced with M, C and K, respectively.

The image forming portion PY includes, at a periphery of a photosensitive drum 1Y, a corona charging device 2Y, an exposure device 3Y, a developing device 4Y, a primary transfer roller 5Y, and a cleaning device 24Y. The photosensitive drum 1Y is prepared by forming a photosensitive layer which has a negative charge polarity on a cylindrical outer peripheral surface of an aluminum cylinder, and is rotated in the direction indicated by an arrow R1 at a process speed of 250 mm/sec to 300 mm/sec. The corona charging device 2Y uniformly and negatively changes the surface of the photosensitive drum 1Y to a dark portion potential VD by irradiating the surface of the photosensitive drum 1Y with the charged particles resulting from the corona discharge.

The exposure device 3Y scans the surface of the photosensitive drum 1Y with a laser beam, obtained by subjecting scanning line image data expanded from a yellow separated color image to ON-OFF modulation, by using a rotating mirror. The surface potential of the photosensitive drum 1Y charged to the dark portion potential VD is lowered to a light portion potential VL by the exposure of the photosensitive drum 1Y to light, so that an electrostatic image for an image is written (formed) on the photosensitive drum 1Y.

The developing device 4Y charges a two component developer containing yellow toner (non-magnetic) and a carrier (magnetic) and carries the developer on a developing sleeve 41. By applying an oscillating voltage in the form of a negative DC voltage Vdc biased with an AC voltage, the toner is transferred onto a portion of the light portion potential VL on the photosensitive drum 1Y which is positive relative to the developing sleeve 41, so that the electrostatic image is reversely developed.

The primary transfer roller 5Y urges the inner surface of the intermediary transfer belt 6 to form a primary transfer portion TY between the photosensitive drum 1Y and the intermediary transfer belt 6. A positive DC voltage is applied to the primary transfer roller 5Y, so that the toner image carried on the photosensitive drum 1Y is primary-transferred onto the intermediary transfer belt 6.

The cleaning device 11Y rubs the photosensitive drum 1Y with the cleaning blade to collect the transfer residual toner remaining on the photosensitive drum 1Y without being transferred onto the intermediary transfer belt 6.

(Secondary Transfer Portion)

Figure 3:
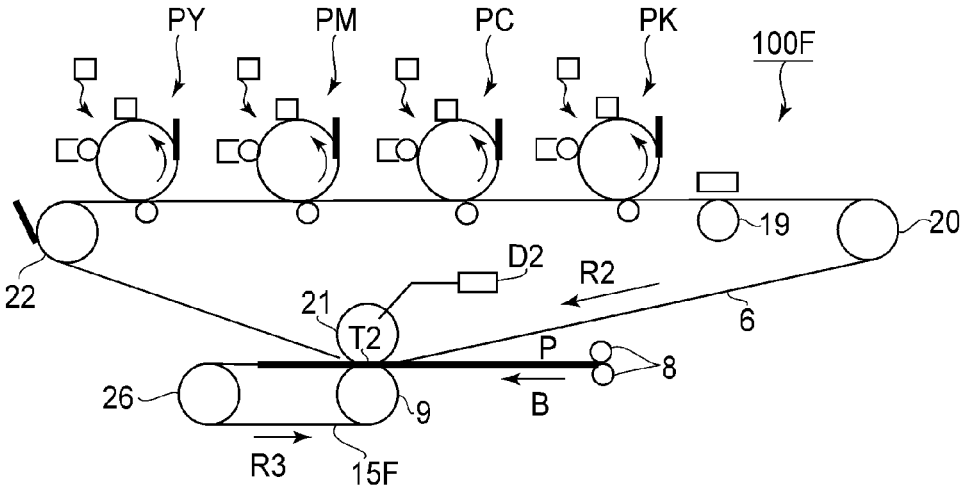
FIGS. 3(*a*) and 3(*b*) are illustrations each showing a structure of an image forming apparatus in a comparative embodiment.
Figure 3:
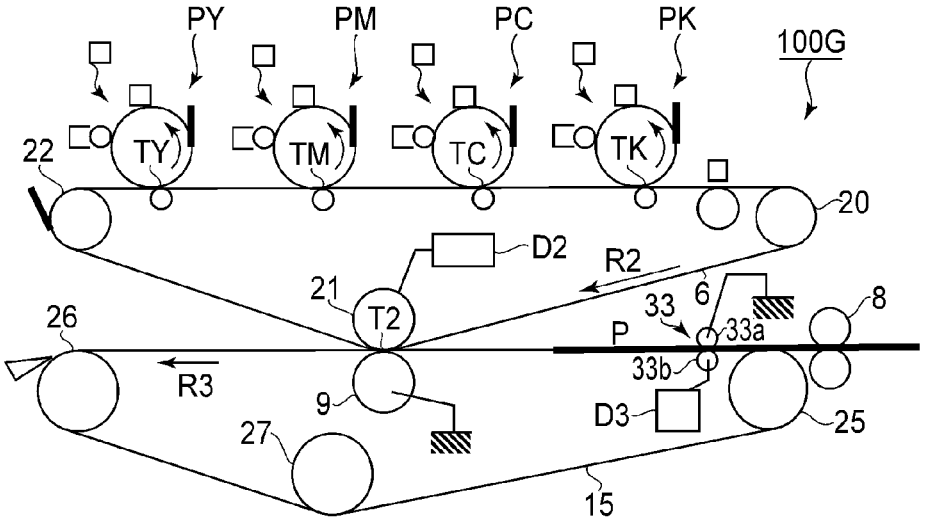
Figure 4:
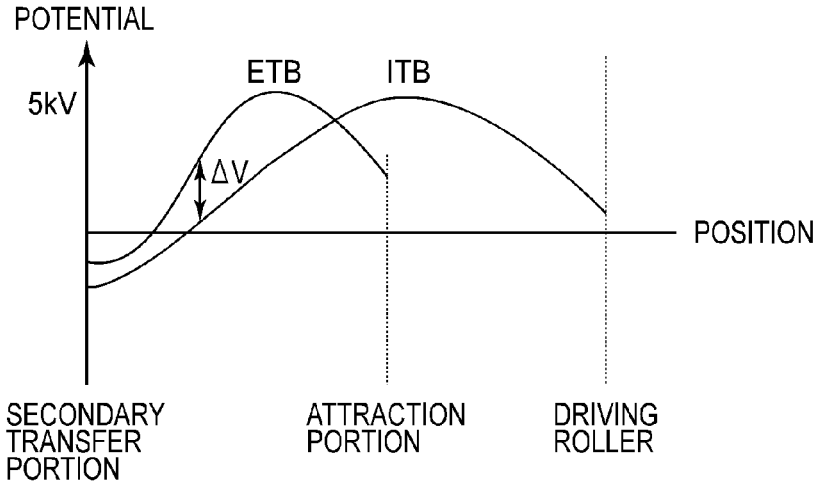
FIG. 4 is an illustration of a potential measurement result of an intermediary transfer belt and a transfer belt of the image forming apparatus in the comparative embodiment.
Figure 5:
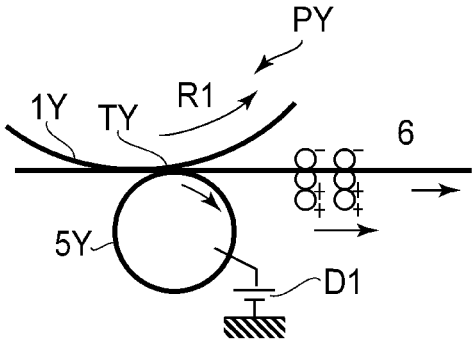
FIGS. 5(*a*) to 5(*d*) are illustrations of a phenomenon that a high potential difference generates between the intermediary transfer belt and the transfer belt.
Figure 5:
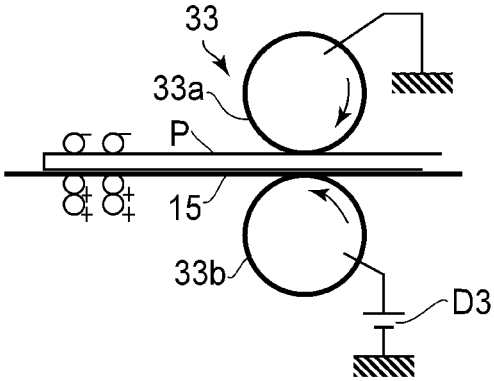
Figure 5:
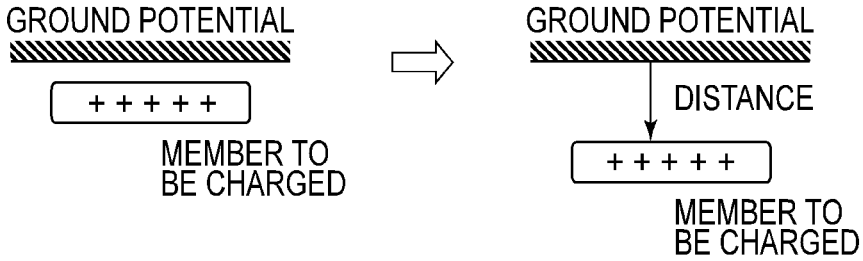
Figure 5:
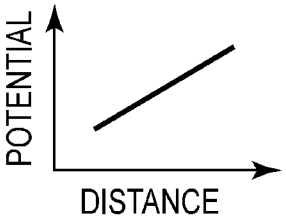

FIGS. 3(*a*) and 3(*b*) are illustrations each showing a structure of an image forming apparatus in a comparative embodiment. FIG. 4 is an illustration of a potential measurement result of an intermediary transfer belt and a transfer belt of the image forming apparatus in the comparative embodiment. FIGS. 5(*a*) to 5(*d*) are illustrations of a phenomenon that a high potential difference generates between the intermediary transfer belt and the transfer belt.

The image forming apparatus 100 shown in FIG. 1 and image forming apparatuses 100F and 100G shown in FIGS. 3(*a*) and 3(*b*) are identically constituted except for arrangement of transfer belts 15 and 15F. For this reason, in FIGS. 3(*a*) and 3(*b*) constituent members common to those shown in FIG. 1 are represented by the same reference numerals or symbols, thus being omitted from redundant description.

As shown in FIG. 1, the secondary transfer portion T2 which is a transfer portion at which the toner image is transferred onto the recording material P is formed between the intermediary transfer belt 6 to which the opposite roller 21 as a first transfer member is contacted at its inner surface and the transfer belt 15 to which the secondary transfer roller 9 as a second transfer member is contacted at its inner surface.

The transfer belt 15 rotates in the direction indicated by an arrow R3 at a speed of 250 mm/sec to 300 mm/sec while carrying the recording material P sent by the registration rollers 8, so that the transfer belt 15 sends the recording material P to the secondary transfer portion T2 and pass the recording material P through the secondary transfer portion T2. The attraction roller 33 constituting the attraction portion nip-conveys the transfer belt 15 on which the recording material is carried, so that the transfer belt 15 is charged to electrostatically attract the recording material P. The transfer belt 15 conveys the recording material P to a separation roller 26 after the toner image is transferred at the secondary transfer portion T2, and then the recording material P is separated from the transfer belt 15 by a separation claw 29. Then, the recording material P is conveyed and introduced into the fixing device 13 in which the toner image is subjected to heat pressing fixing process.

As shown in FIG. 3(*a*), in the image forming apparatus 100F in a comparative embodiment, the transfer belt 15F is extended around and supported by the secondary transfer roller 9 and the separation roller 26. In the image forming apparatus 100F, the recording material P such as thin paper having low rigidity caused deformation of its leading end under a curl condition of the leading end at a position from the registration rollers 8 to the secondary transfer portion T2, so that the recording material P was not able to be stably conveyed to the secondary transfer portion T2 in some cases. Further, the recording material P such as the thin paper having low rigidity caused delay at its leading end by contact with a guide disposed between the registration rollers 8 and the secondary transfer portion T2, so that the recording material P was not able to be stably conveyed to the secondary transfer portion T2 in some cases.

For this reason, as shown in FIG. 3(*b*), in the image forming apparatus 100G in another comparative embodiment, by following the recording material conveying belt described in JP-A 2007-003634, the transfer belt 15 is disposed in a state in which the transfer belt 15 is extended to the upstream side of the secondary transfer portion T2, and the attraction portion 33 is provided on the upstream side. The image forming apparatus 100G employs the constitution that the recording material P is electrostatically attracted to the transfer belt 15 by the attraction roller 33 disposed on the upstream side of the secondary transfer portion T2 and thus is stably conveyed to the secondary transfer portion T2.

However, in the image forming apparatus 100G in the comparative embodiment, on the upstream side of the secondary transfer portion T2, between the intermediary transfer belt 6 and the recording material P carried on the transfer belt 15, the electric discharge can occur. When the electric discharge occurs, the toner image on the intermediary transfer belt 6 is disturbed, so that the disturbance of the toner image can appear as a defective image after the toner image is transferred onto the recording material P.

Here, the charge potential of the intermediary transfer belt 6 at each of the primary transfer portions TY, TM, TC and TK and the charge potential of the transfer belt 15 at the position of the attraction roller 33 are equal in polarity and are several hundred volts in voltage level. For this reason, an electric field exceeding 100 V/mm such that the electric discharge occurs should not generate.

Therefore, when the potential at each portion along a rotational direction of each of the intermediary transfer belt 6 and the transfer belt 15 during continuous image formation was measured by using a potential sensor, a measurement result as shown in FIG. 4 was obtained.

As shown in FIG. 4, the intermediary transfer belt 6 ("ITB") was increased in potential after being spaced apart from the driving roller 20 and the transfer belt 15 ("ETB") was increased in potential after being spaced apart from the attraction roller 33, so that a potential difference ΔV was generated between the intermediary transfer belt 6 and the transfer belt 15 on the upstream side of the secondary transfer portion T2. The potential difference exceeded 2000 V and was at a level such that the abnormal electric discharge could occur.

The reasons why the potential of the intermediary transfer belt 6 after the intermediary transfer belt 6 is spaced from the driving roller 20 and why the potential of the transfer belt 15 after the transfer belt 15 is spaced from the attraction roller 33 are explained as follows with reference to FIGS. 5(*a*) and 5(*b*).

As shown in FIG. 5(*a*), negative charge and positive charge possessed by the intermediary transfer belt 6 after passes through the primary transfer portion TY of the image forming portion PY are not equal in amount to each other and an excessive positive charge is present, so that the intermediary transfer belt 6 is apparently charged to the positive polarity. The positively charged intermediary transfer belt is rotated to reach the driving roller 20 and then when the intermediary transfer belt 6 is moved apart from the driving roller 20, the potential of the intermediary transfer belt 6 is increased.

As shown in FIG. 5(*b*), negative charge and positive charge possessed by the transfer belt 15 after passes through the attraction roller 33 are not equal in amount to each other and an excessive positive charge is present, so that the transfer belt 15 is apparently charged to the positive polarity. When the positively charged transfer belt 15 is rotated then is moved apart from the attraction roller 33, the potential of the transfer belt 15 is increased.

As shown in FIG. 5(*c*), when the charged object (member to be charged) is spaced from the ground electrode (ground potential), electrostatic capacity between the object and the ground potential is decreased, so that the charge potential of the object is increased.

As shown in FIG. 5(*d*), when the distance between the object and the ground potential is increased, the electrostatic capacity of a capacitor through an air layer is decreased. Then, when the electric charge of the capacitor with an electrostatic capacity C is Q and the potential difference between ends of the capacitor is V, the following relationship is satisfied.

$$V=Q/C$$

$C=k\cdot A/d$ ($k$: constant, $A$: opposing area, $d$: distance)

For this reason, it would be considered that the intermediary transfer belt 6 and the transfer belt 15 are increased in potential when an air gap d between the belt and the ground potential is increased, after the belt is charged, to decrease the electrostatic capacity C, the respective potentials are increased. Further, a potential rise pattern of the intermediary transfer belt 6 and the transfer belt 15 varies depending on the types or the like of the toner image to be formed and the recording material P to be used. As a result, on the upstream side of the secondary transfer portion T2, the potential difference ΔV is generated between the intermediary transfer belt 6 and the transfer belt 15.

That is, as in the image forming apparatus 100F, at the portion where the intermediary transfer belt 6 and the transfer belt 15 which were charged without being regulated in potential were close to each other, there was a possibility that the abnormal electric discharge occurred due to their unstable potentials to disturb the toner image on the intermediary transfer belt 6.

Therefore, in the following embodiments, the surface potential of the recording material P which is electrostatically attracted and conveyed by the transfer belt 15 is regulated by disposing a sheet-like electrode member 36 at an inner surface of the transfer belt 15 on the upstream side of the secondary transfer portion T2. Similarly, a sheet-like electrode member 35 is disposed at an inner surface of the intermediary transfer belt 6 on the upstream side of the secondary transfer portion T2, so that the surface potential of the intermediary transfer belt 6 is regulated. As a result, on the upstream side of the secondary transfer portion T2, the abnormal electric discharge is prevented and a good transfer image is obtained.

Embodiment 1

Figure 7:
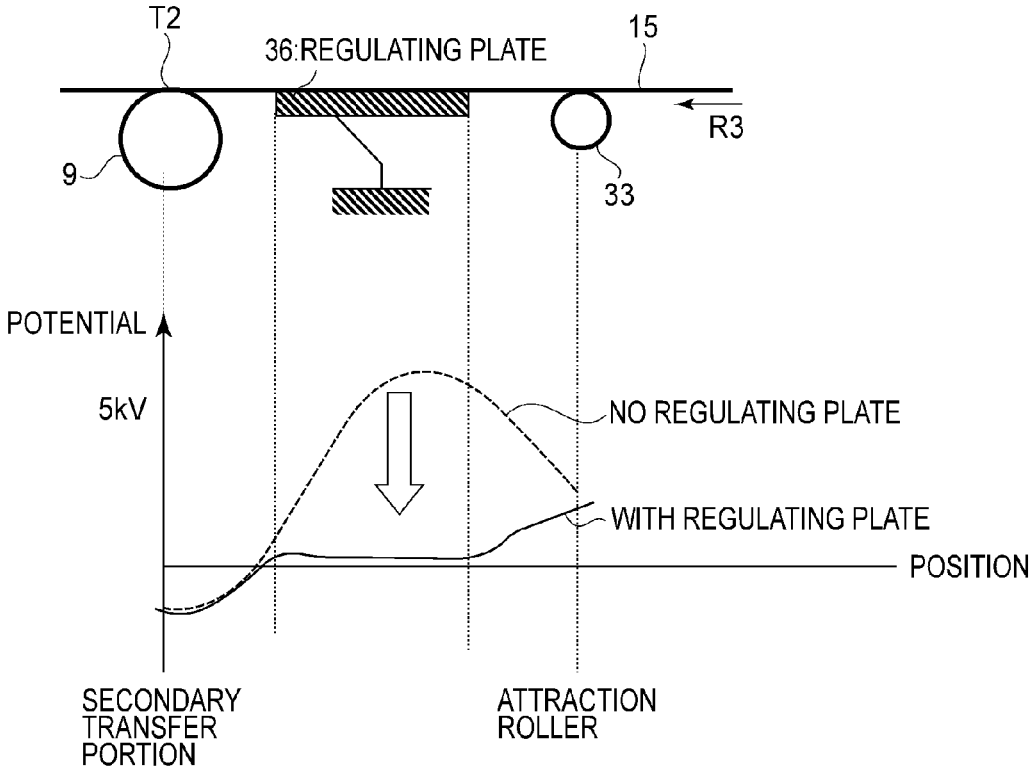
FIG. 7 is an illustration of an effect of a potential regulating plate.
Figure 6:
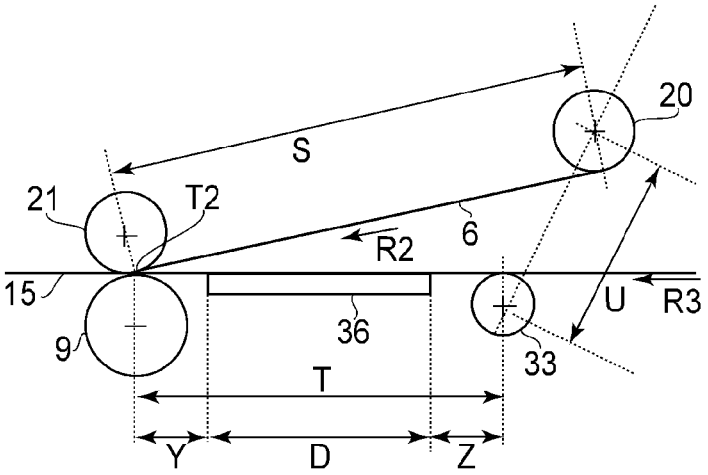
FIGS. 6(*a*) and 6(*b*) are illustrations of electrode arrangement on an upstream side of a secondary transfer portion in Embodiment 1.
Figure 6:
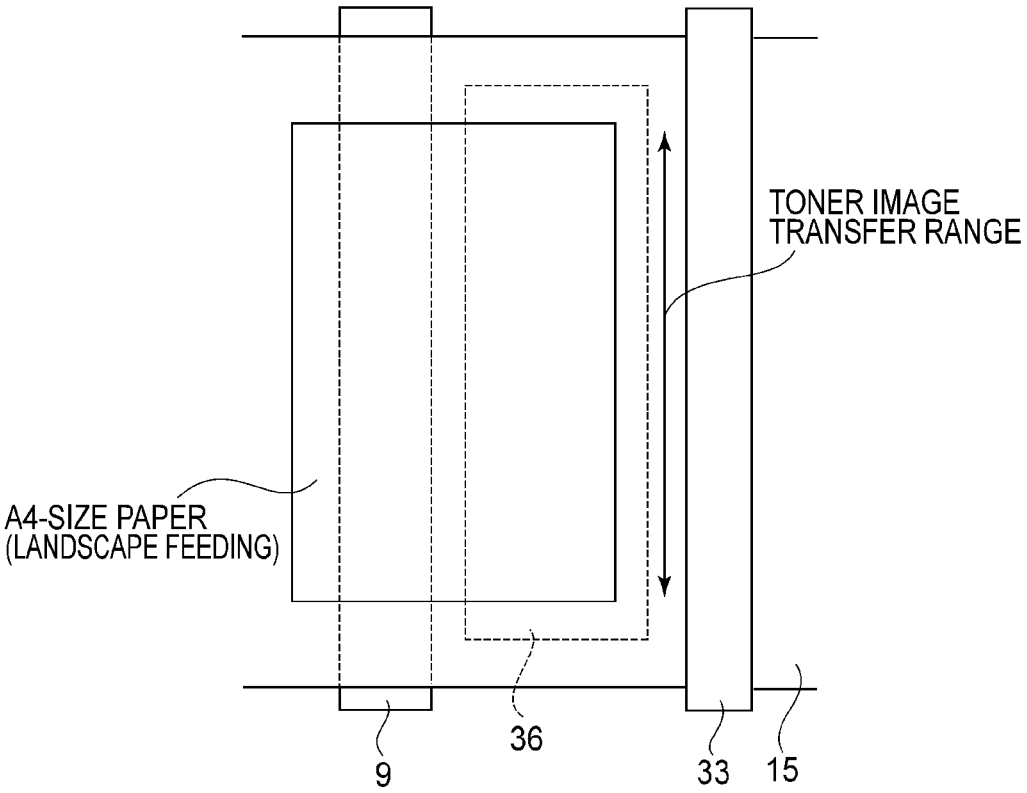
Figure 8:
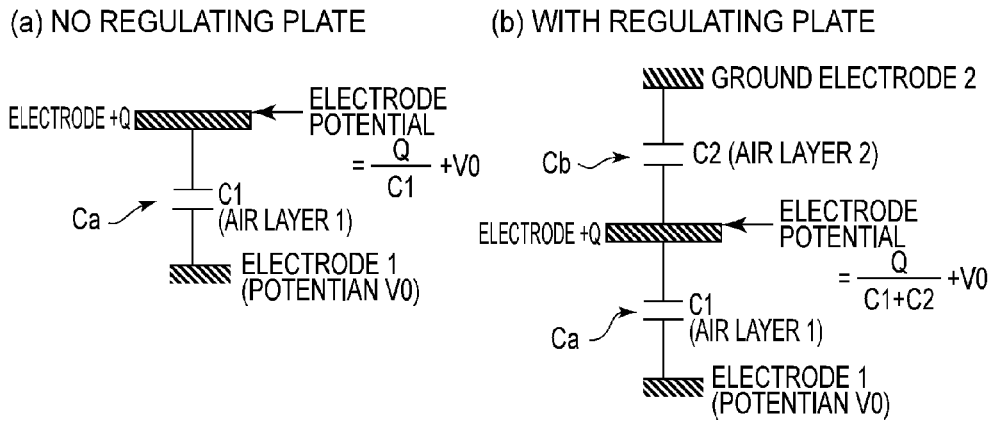
FIGS. 8(*a*) and 8(*b*) are illustrations of equivalent circuits with no potential regulating plate and with the potential regulating plate, respectively.
Figure 9:
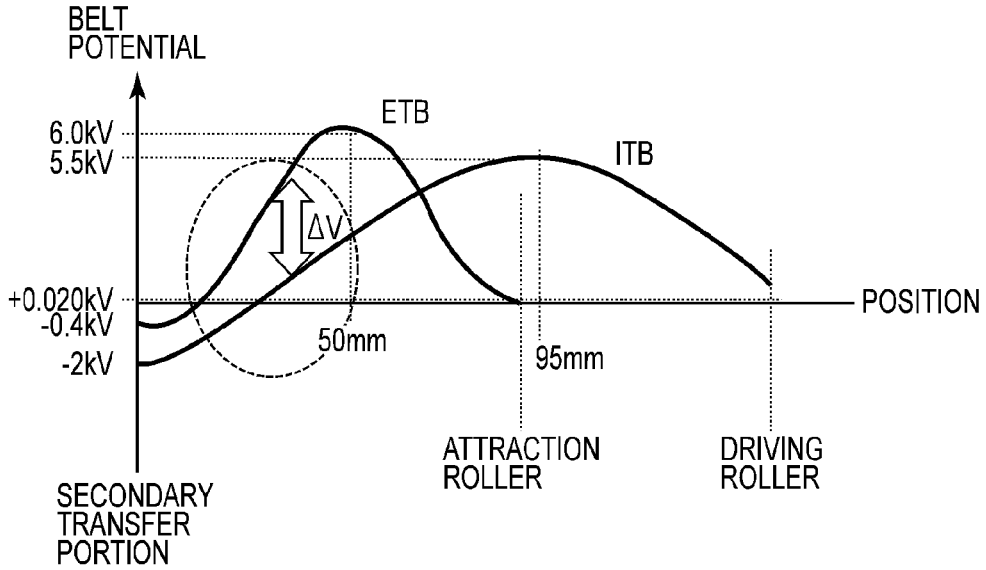
FIGS. 9(*a*) and 9(*b*) are illustrations of comparison results of potential measurement with no potential regulating plate and with the potential regulating plate, respectively.
Figure 9:
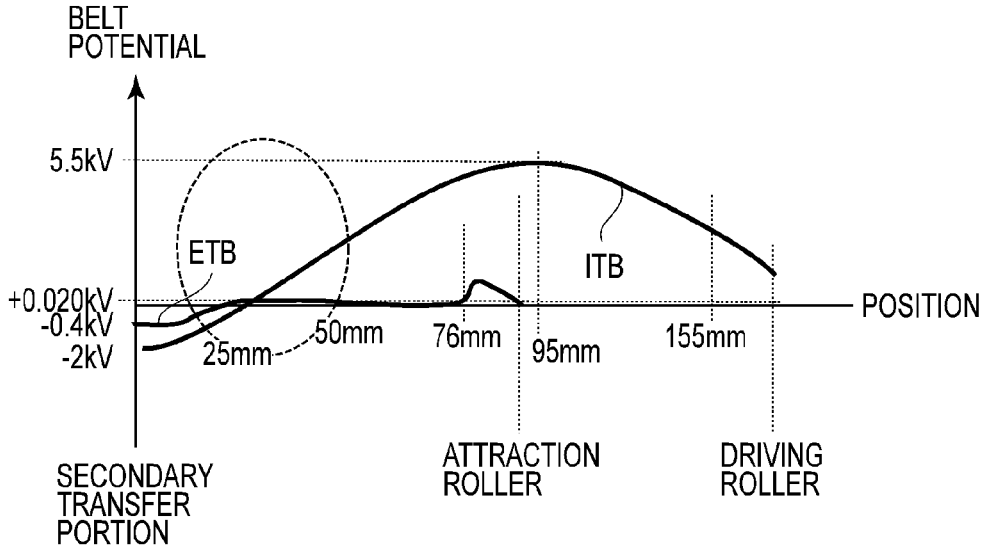

FIGS. 6(*a*) and 6(*b*) are illustrations of electrode arrangement on an upstream side of a secondary transfer portion in Embodiment 1. FIG. 7 is an illustration of an effect of a potential regulating plate. FIGS. 8(*a*) and 8(*b*) are illustrations each showing an equivalent circuit on the periphery of the potential regulating plate. FIGS. 9(*a*) and 9(*b*) are illustrations of a comparison result of potential measurement when the potential regulating plate is absent and present, respectively.

As shown in FIG. 1, the transfer belt 15 is extended around and supported by a separation roller 26 also functioning as a driving roller, a tension roller 27 and an entrance roller 25 and is driven by the separation roller 26, so that the transfer belt 15 is rotated in a direction indicated by an arrow R3 at a process speed of 250-300 mm/sec.

An attraction roller 33 controlling the attraction portion is constituted by a roller 33*a* disposed on an outer surface of the transfer belt 15 and a roller 33*b* disposed on an inner surface of the transfer belt 15. The roller 33*a* is connected to a ground potential, and the roller 33*b* is connected to a power source D3. The power source D3 applies a DC voltage, which is constant current-controlled at +15 μA to +30 μA, to the roller 33*b* contacted to the inner surface of the transfer belt 15. As a result, the transfer belt 15 is positively charged, so that the recording material P is electrostatically attracted to the surface of the transfer belt 15.

The opposite roller 21 constituting the secondary transfer portion T2 is connected to the power source D2, and the secondary transfer roller 9 is connected to the ground potential. When the transfer belt 15 carrying the recording material P passes through the secondary transfer portion T2, the power source D2 applies to the opposite roller 21 the DC voltage, which is constant current-controlled at, e.g., −30 μA to −40 μA, of a (negative) polarity identical to the charge polarity of the toner image. As a result, the toner image carried on the intermediary transfer belt 6 is transferred onto the recording material P.

The intermediary transfer belt 6 may be formed in a thickness of 0.07 mm to 1 mm by incorporating carbon black as an antistatic agent in an appropriate amount in a resin material such as polyimide or polycarbonate or in various rubber materials or the like so as to adjust a volume resistivity at $1\times10^{9}$ Ω·cm to $1\times10^{13}$ Ω·cm.

The secondary transfer roller 9 has been finished to have an outer diameter of 24 mm by forming an elastic layer of an ion conductive foamed rubber (NBR rubber) around a core metal (metal shaft). A resistance value of the secondary transfer roller 9 was $1\times10^{5}$Ω to $5\times10^{8}$Ω when measured in a normal temperature and normal humidity environment (NN: 23° C., 50% RH) at an applied voltage of 2 kV.

The primary transfer roller 5Y has been finished to have the outer diameter of 16 mm to 20 mm by forming the elastic layer of the ion conductive foamed rubber (NBR rubber) around a core metal (metal shaft). The resistance value of the primary transfer roller 5Y was $1\times10^{5}$Ω to $1\times10^{8}$Ω when measured in the NN environment at 2 kV.

The opposite roller 21 has been finished to have an outer diameter of 20 mm by forming an elastic layer of an electron conductive rubber (EPDM) around a core metal (metal shaft). A resistance value of the opposite roller 21 was $1\times10^{5}$Ω to $1\times10^{8}$Ω when measured in the NN environment at 50 V.

The roller 33*b* of the attraction roller 33 has been finished to have the outer diameter of 18 mm by forming the elastic layer of the ion conductive solid rubber (NBR rubber) around a core metal (metal shaft). The resistance value of the roller 33*b* was $1\times10^5\Omega$ to $1\times10^6\Omega$ when measured in the NN environment at 50 V.

The roller 33*a* of the attraction roller 33 is a fur brush roller of 18 mm in outer diameter formed by planting electroconductive nylon fibers of 5 mm in fiber length around the core metal of 8 mm in diameter. The resistance value of the roller 33*a* was $1\times10^5\Omega$ to $1\times10^6\Omega$ when measured in the NN environment at 100 V. The fur brush of the roller 33*a* is disposed with a (brush) penetration depth of 1.5 mm to 2 mm with respect to the transfer belt 15.

In Embodiment 1, the potential regulating plate 36 which is grounded and is a sheet-like electrode was provided so as to contact the transfer belt 15 at a position in which the transfer belt 15 passed through the attraction roller 33 but did not pass through the secondary transfer roller 9. In this embodiment, the potential regulating plate 36 is contacted to the inner surface of the transfer belt 15 but in the case of non-contact, a distance between the potential regulating plate 36 and the transfer belt 15 may be 1 mm to 5 mm. A positional relationship between the potential regulating plate 36 and its peripheral members is shown in FIGS. 6(*a*) and 6(*b*).

As shown in FIG. 6(*a*), a distance S between the driving roller 20 and the opposite roller 21 supporting the intermediary transfer belt 6 was 170 mm, and an outer diameter of the driving roller 20 was 20 mm. A distance T between the attraction roller 33 and the secondary transfer roller 9 supporting the transfer belt 15 was 90 mm, and a center distance U between the attraction roller 33 and the driving roller 20 was 92 mm. The closest distance Y between the potential regulating plate 36 and a contact point between the transfer belt 15 and the secondary transfer roller 9 was 27 mm, and the closest distance Z between the potential regulating plate 36 and a contact point between the attraction roller 33 and the transfer belt 15 was 14 mm. A width D of the potential regulating plate 36 with respect to a conveyance direction of the transfer belt 15 was 49 mm. As shown in FIG. 6(*b*), a length of the potential regulating plate 36 with respect to a width direction perpendicular to the conveyance direction of the transfer belt 15 was 350 mm which was larger than 298 mm which was a length of the recording material having a passable maximum width (A4-size paper width in landscape feeding in this embodiment). Further, the length of the potential regulating plate 36 with respect to the width direction was made smaller than that of the transfer belt 15 with respect to the width direction.

As shown in FIG. 7, in the case where the potential regulating plate 35 as an example of the electrode member is present on the inner surface of the transfer belt 15, compared with the case where the potential regulating plate 36 is absent, potential rise of the transfer belt 15 can be prevented. This is because electric charge Q of the transfer belt 15 injected by the attraction roller 33 is confined in capacity (capacitance) of an air gap capacitor between the transfer belt and the potential regulating plate 36 and thus the potential of the transfer belt 15 can be kept at a low level. This is also because a lowering in capacity of the air gap capacitor between the transfer belt 15 and the attraction roller 33 when the transfer belt 15 is spaced from the attraction roller 33 is supplemented by the air gap capacitor between the transfer belt 15 and the potential regulating plate 36. The reason why the potential rise of the transfer belt 15 in the case where the potential regulating plate 36 is present can be prevented compared with the case where the potential regulating plate 36 is absent can be considered as follows.

As shown in FIG. 8(*a*), in the case where the potential regulating plate 36 is absent, a state in which an air gap capacitor Ca with a capacity C1 connected to the roller 33*b* of the attraction roller 33 with a potential V0 at one end thereof is connected to the transfer belt 15 having electric charge +Q is formed. The capacity C1 of the capacitor Ca is determined by the capacity of an air layer in the neighborhood of a contact portion between the attraction roller 33 and the transfer belt 15. At that time, the potential of the transfer belt 15 is Q/C1+V0.

As shown in FIG. 8(*b*), in the case where the potential regulating plate 36 is present, a state in which not only the air gap capacitor Ca with the capacity C1 cut also an air gap capacitor Cb connected to ground potential are connected to the transfer belt 15 having the electric charge +Q is formed. The air gap capacitor Cb with a capacitor C2 created when the potential regulating plate 36 and the transfer belt 15 are opposed to each other is added, so that the potential of the transfer belt 15 is Q/(C1+C2)+V0. By the addition of the air gap capacitor Cb, on the basis of the transfer belt 15 assuming the electric charge, the capacity is increased from C1 to (C1+C2), so that the potential of the transfer belt 15 is lowered even when the same amount of electric charge +Q is possessed by the transfer belt 15.

As shown in FIGS. 9(*a*) and 9(*b*), also in an actual measurement result, compared with the case where the potential regulating plate 36 is absent, the potential of the transfer belt 15 is lowered in the case where the potential regulating plate 36 is present. As shown in FIG. 9(*a*), in the case where the potential regulating plate 36 was removed, the potential of the intermediary transfer belt 6 was increased after the intermediary transfer belt 6 passed through the driving roller 20, and the potential of the transfer belt 15 was increased after the transfer belt 15 passed through the attraction roller 33.

As a result, a potential difference ΔV exceeding 4000 V was generated between the intermediary transfer belt 6 and the transfer belt 15 on an upstream side of the secondary transfer portion T2, so that an electric field was generated before the secondary transfer portion T2 in a direction in which the negatively charged toner image was attracted to the transfer belt 15. By this electric field, a carrying force for carrying the toner image on the intermediary transfer belt 6 was lowered, so that a transfer image was disturbed in front of the secondary transfer portion T2.

As shown in FIG. 9(*b*), in the case where the potential regulating plate 36 was attached, the intermediary transfer belt 6 was increased in potential after being spaced from the driving roller 20 but the transfer belt 15 was not increased in potential after being spaced from the attraction roller 33. For this reason, the large potential difference ΔV generated on the upstream side of the secondary transfer portion T2 was eliminated, so that the electric field at a level such that the transfer image was disturbed on the upstream side of the secondary transfer portion T2 was not observed.

In both of the case where the potential regulating plate 36 was present and the case where the potential regulating plate 36 was absent, continuous image formation on 10 sheets was effected by using the recording material ("CS814", mfd. by Nippon Paper Group, Inc.), so that an occurrence frequency of each of scattering and an abnormal electric charge image was compared. An evaluation result is shown in Table 1.

TABLE 1

| PRP *1 | Scattering *2 | Image *3 |
|---|---|---|
| PRESENCE | ○ | ○ |
| ABSENCE | X | X |

*1: "PRP" represents the potential regulating plate.
*2: "Scattering" represents toner scattering (pre-transfer of toner image before secondary transfer).
*3: "Image" represents the abnormal electric discharge image.

As shown in Table 1, in Embodiment 1, by providing the potential regulating plate 36, the degrees of the abnormal image and scattering generated on the upstream side of the secondary transfer portion T2 are decreased compared with those in the case where the potential regulating plate 36 is not provided. This is because in the case where the potential regulating plate 36 is present, the potential of the transfer belt 15 on the upstream side of the secondary transfer portion T2 can be lowered and therefore the electric field, which disturbs the toner image on the intermediary transfer belt 6, on the upstream side of the secondary transfer portion T2 can be alleviated.

Incidentally, as shown in FIG. 9(*b*), the potential difference between the intermediary transfer belt 6 ("ITB") and the transfer belt 15 ("ETB") at the secondary transfer portion T2 corresponds to a potential difference necessary to carry a transfer current. By the influence of this potential difference, there is also a portion, where an opposite distance between the intermediary transfer belt 6 and the transfer belt 15 is narrowed and the electric field is increased, located on upstream side of the secondary transfer portion T2 by 5 mm to 10 mm. However, in this embodiment, a defective image caused due to occurrence of abnormal electric discharge at the upstream position from the secondary transfer portion T2 by 5 mm to 10 mm did not occur. As shown in FIG. 9(*a*), also in the case where the potential regulating plate 36 is absent, a similar electric field is generated at the upstream position from the secondary transfer portion T2 by 5 mm to 10 mm but it is confirmed that the defective image is not generated.

According to Embodiment 1, the electric field which disturbs the toner image on the intermediary transfer belt 6 on the upstream side of the secondary transfer portion T2 can be remarkably alleviated and it is possible to prevent the abnormal image and scattering generated on the upstream side of the secondary transfer portion T2.

According to Embodiment 1, as a result that the potential of the transfer belt 15 is lowered, the potential difference ΔV between the intermediary transfer belt 6 and the transfer belt 15 is decreased. As a result, the toner image disturbance on the intermediary transfer belt 6 by the electric field generated by the potential difference ΔV and the abnormal electric discharge occurring on the upstream side of the secondary transfer portion T2 can be suppressed, so that the defective image can be prevented.

According to Embodiment 1, the potential regulating plate 36 is disposed on the inner surface of the transfer belt 15, so that the potential regulating plate 36 can be disposed close to the transfer belt 15 without being contacted to the toner image on the intermediary transfer belt 6 and the recording material P on the transfer belt 15. As a result, the electrostatic capacity C2 of the air gap capacitor between the transfer belt 15 and the potential regulating plate 36 can be increased, so that it becomes possible to lower the potential of the transfer belt 15.

According to Embodiment 1, the potential regulating plate 36 disposed on the inner surface of the transfer belt 15 is grounded through the main assembly of the image forming apparatus 100, so that the potential of the transfer belt 15 can be stabled. As the potential regulating plate 36 is brought near to the transfer belt 15, the air gap capacity C2 formed between the transfer belt 15 and the potential regulating plate 36 becomes large, so that the potential of the transfer belt 15 is lowered and the potential difference ΔV is small and stabilized. When the potential regulating plate 36 contacts the transfer belt 15, only the gap formed by tolerances of surface smoothness of the potential regulating plate 36 and smoothness of the transfer belt 15 is formed and thus the contact state is more desirable. For that reason, in Embodiment 1, the potential regulating plate 36 was contacted to the transfer belt 15.

Embodiment 2

Figure 10:
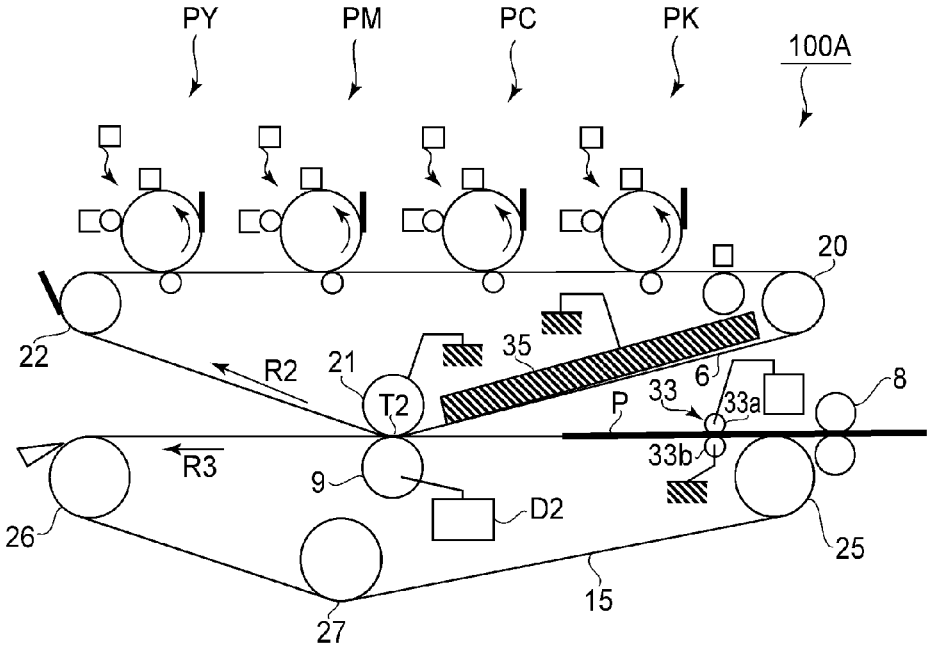
FIG. 10 is an illustration of a structure of an image forming apparatus in Embodiment 2.
Figure 11:
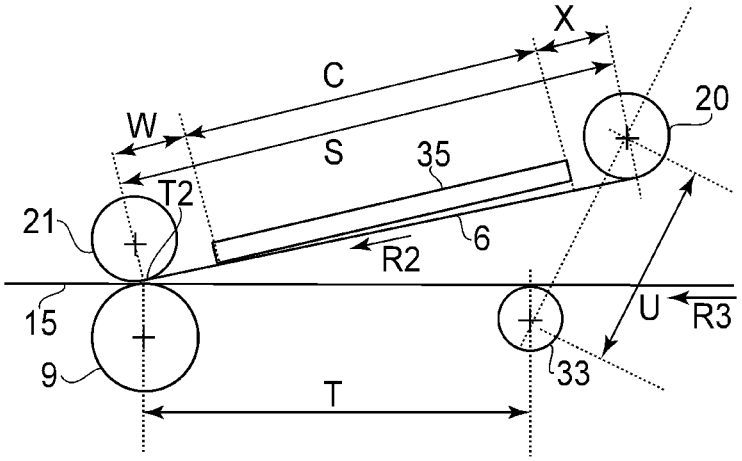
FIGS. 11(*a*) and 11(*b*) are illustrations of electrode arrangement on an upstream side of a secondary transfer portion in Embodiment 2.
Figure 11:
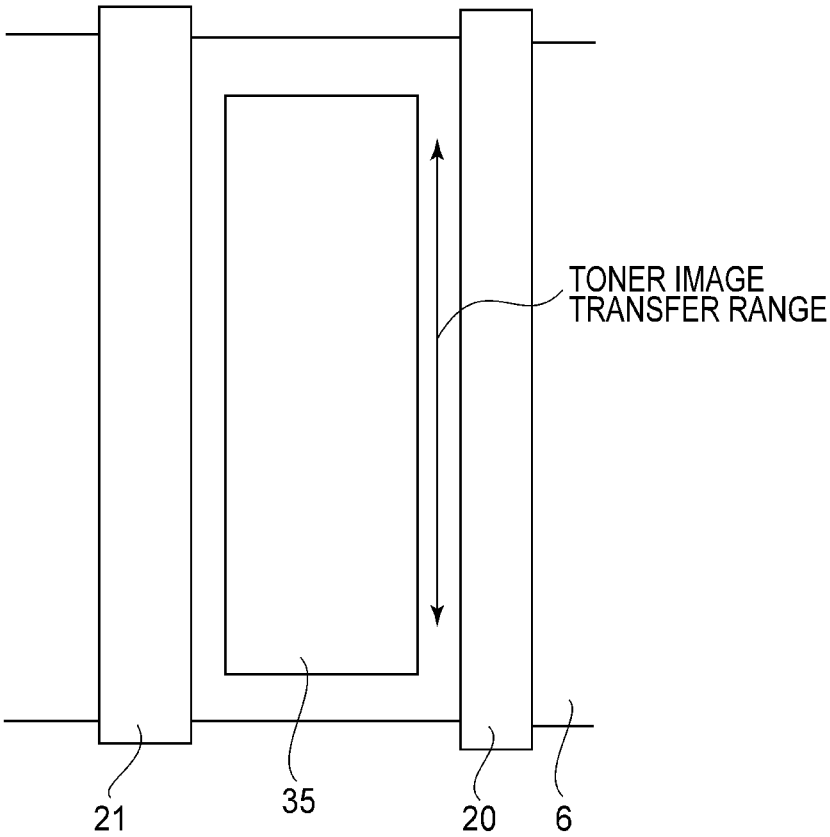
Figure 12:
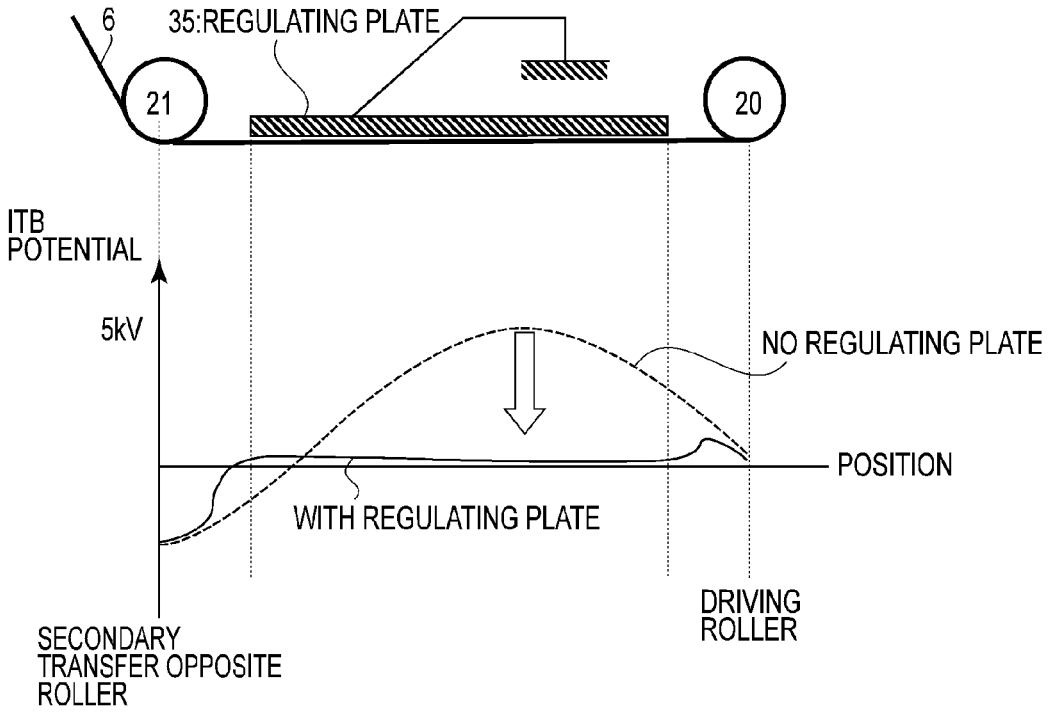
FIG. 12 is an illustration of an effect of a potential regulating plate.
Figure 13:
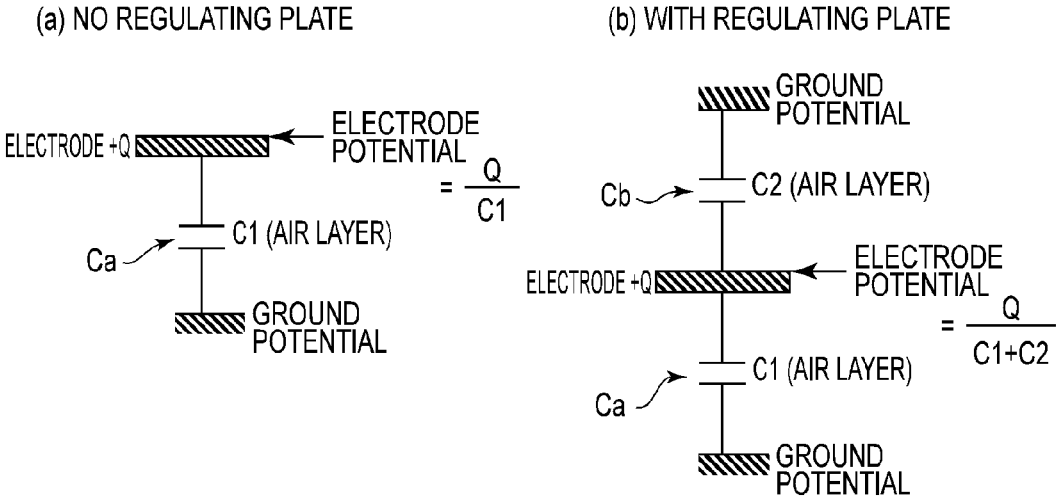
FIGS. 13(*a*) and 13(*b*) are illustrations of equivalent circuits with no potential regulating plate and with the potential regulating plate, respectively.
Figure 14:
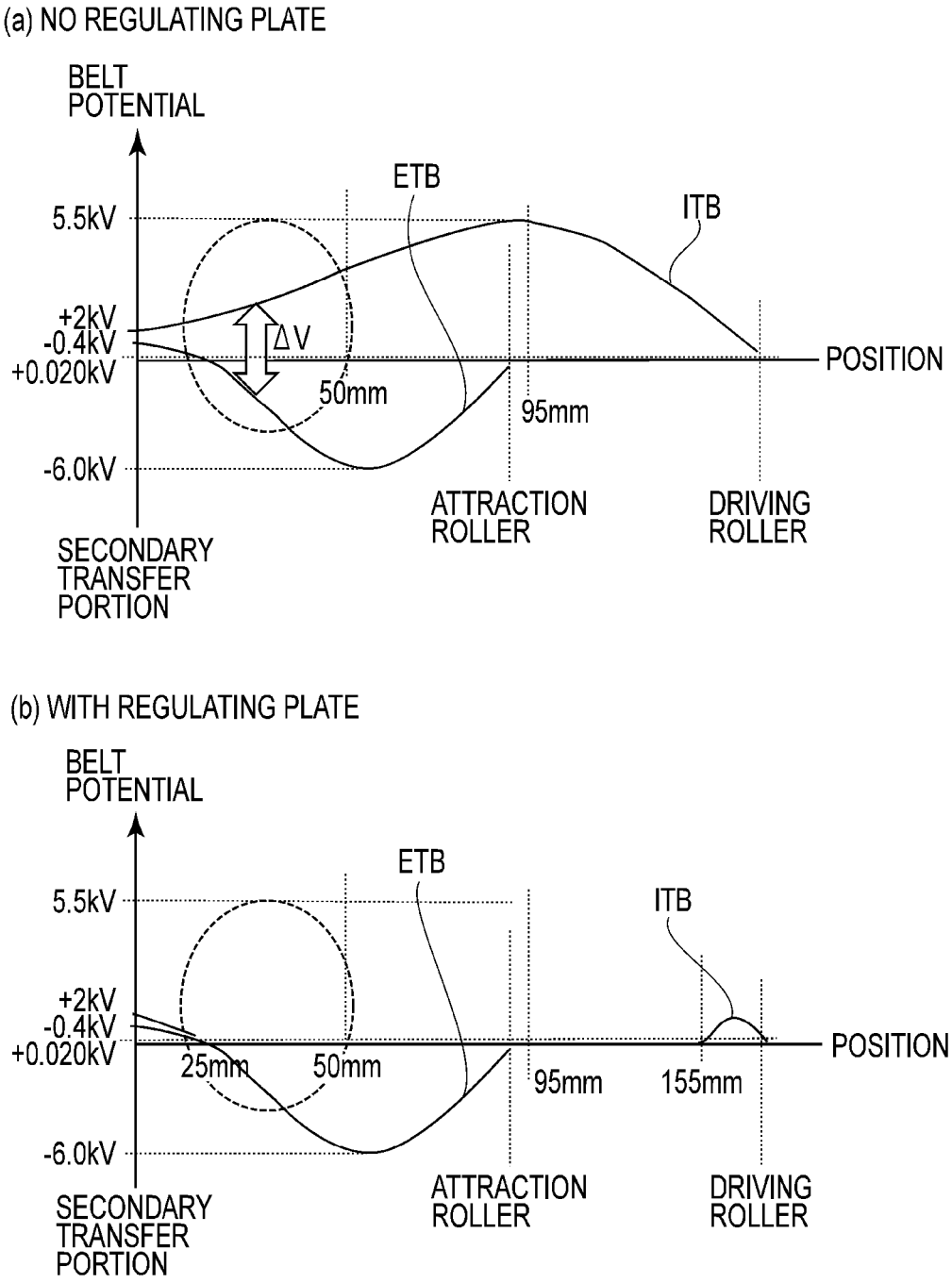
FIGS. 14(*a*) and 14(*b*) are illustrations of comparison results of potential measurement with no potential regulating plate and with the potential regulating plate, respectively.

FIG. 10 is an illustration of a structure of the image forming apparatus in Embodiment 2. FIGS. 11(*a*) and 11(*b*) are illustrations of electrode arrangement on an upstream side of a secondary transfer portion in Embodiment 2. FIG. 12 is an illustration of an effect of a potential regulating plate. FIGS. 13(*a*) and 13(*b*) are illustrations each showing an equivalent circuit on the periphery of the potential regulating plate. FIGS. 14(*a*) and 14(*b*) are illustrations of a comparison result of potential measurement when the potential regulating plate is absent and present, respectively.

The image forming apparatus 100 shown in FIG. 1 and an image forming apparatus 100A shown in FIG. 10 are equivalently constituted except for a voltage applying method at the secondary transfer portion T2 and arrangement of the potential regulating plate. For this reason, in FIG. 9, constituent members common to those shown in FIG. 1 are represented by common reference numerals or symbols and will be omitted from redundant description.

As shown in FIG. 10, in the image forming apparatus 100A in this embodiment, the power source D3 is connected to the roller 33*a* disposed on the outer surface of the transfer belt 15 and the roller 33*b* disposed on the inner surface of the transfer belt 15 is connected to a ground potential. The power source D3 applies a DC voltage, which is constant current-controlled at −15 μA to −30 μA, to the roller 33*a* contacted to the outer surface of the transfer belt 15. As a result, the recording material P is negatively charged, so that the recording material P is electrostatically attracted to the surface of the transfer belt 15.

The opposite roller 21 constituting the secondary transfer portion T2 is connected to the ground potential, and the secondary transfer roller 9 is connected to the power source D2. When the transfer belt 15 carrying the recording material P passes through the secondary transfer portion T2, the power source D2 applies to the secondary transfer roller 9 the DC voltage, which is constant current-controlled at, e.g., +30 μA to +40 μA, of a (positive) polarity opposite to the charge polarity of the toner image. As a result, the toner image carried on the intermediary transfer belt 6 is secondary-transferred onto the recording material P.

In Embodiment 2, the potential regulating plate 35 which is grounded and is a sheet-like electrode was provided as an example of a second electrode member so as to contact the intermediary transfer belt 6 at a position in which the intermediary transfer belt 6 passed through the grounded driving roller 20 but did not pass through the opposite roller 21. In this embodiment, the potential regulating plate 35 is contacted to the intermediary transfer belt 6 but in the case where the potential regulating plate 35 is disposed in a non-contact state, an air gap (distance) may be 1 mm to 5 mm. A positional relationship between the potential regulating plate 35 as the example of the second electrode member and its peripheral members is shown in FIGS. 11(*a*) and 11(*b*).

As shown in FIG. 11(*a*), a distance S between the driving roller 20 and the opposite roller 21 supporting the intermediary transfer belt 6 was 170 mm, and an outer diameter of the driving roller 20 was 20 mm. The closest distance W from a contact point between the opposite roller 21 and the intermediary transfer belt 6 to the potential regulating plate 35 was 25 mm, and the closest distance X from a contact point between the driving roller 20 and the intermediary transfer belt 6 to the potential regulating plate 35 was 15 mm. A width C of the potential regulating plate 35 with respect to a conveyance direction of the intermediary transfer belt 6 was 130 mm. As shown in FIG. 11(*b*), a length of the potential regulating plate 35 with respect to a width direction perpendicular to the conveyance direction of the intermediary transfer belt 6 was 350 mm which was larger than the toner image width corresponding to a length of the recording material having a passable maximum width (A4-size paper width in landscape feeding in this embodiment). Further, the length of the potential regulating plate 35 was larger than the length of the recording material having the passable maximum width. Further, the length of the potential regulating plate 35 with respect to the width direction was made smaller than that of the intermediary transfer belt 6 with respect to the width direction.

As shown in FIG. 12, in the case where the potential regulating plate 36 is disposed on the inner surface of the intermediary transfer belt 6, compared with the case where the potential regulating plate 36 is not disposed, potential rise of the intermediary transfer belt 6 after passing through the driving roller 20 can be prevented. This is because electric charge Q of the intermediary transfer belt 6 injected by the image forming portions (PY, PM, PC, PK: FIG. 10) is confined in capacity (capacitance) of an air gap capacitor between the intermediary transfer belt 15 and the potential regulating plate 35 and thus the potential of the intermediary transfer belt 6 can be kept at a low level. This is also because a lowering in capacity of the air gap capacitor between the intermediary transfer belt 6 and the driving roller 20 when the intermediary transfer belt 6 is spaced from the driving roller 20 is supplemented by the air gap capacitor between the intermediary transfer belt 6 and the driving roller 20. The reason why the potential rise of the intermediary transfer belt 6 in the case where the potential regulating plate 35 is present can be prevented compared with the case where the potential regulating plate 35 is absent can be considered as follows.

As shown in FIG. 13(*a*), in the case where the potential regulating plate 35 is absent, a state in which an air gap capacitor Ca with a capacity C1 connected to driving roller 20 with the ground potential at one end thereof is connected to the intermediary transfer belt 15 having electric charge +Q is formed. The capacity C1 of the capacitor Ca is determined by the capacity of an air layer in the neighborhood of a contact portion between the driving roller 20 and the intermediary transfer belt 6. At that time, the potential of the intermediary transfer belt 6 is Q/C1.

As shown in FIG. 13(*b*), in the case where the potential regulating plate 35 is present, a state in which not only the air gap capacitor Ca with the capacity C1 cut also an air gap capacitor Cb connected to ground potential are connected to the intermediary transfer belt 6 having the electric charge +Q is formed. The air gap capacitor Cb with a capacitor C2 is formed by a gap air layer between with a capacity the potential regulating plate 35 and the intermediary transfer belt 6. At that time, the potential of the intermediary transfer belt 6 is Q/(C1+C2). This is because, by the addition of the capacity of the air gap capacitor Cb between the potential regulating plate 35 and the intermediary transfer belt 6, on the basis of the intermediary transfer belt 6 assuming the electric charge, the capacity is increased from C1 to (C1+C2), so that the potential of the intermediary transfer belt 6 is lowered even when the same amount of electric charge +Q is possessed by the intermediary transfer belt 6.

As shown in FIGS. 14(*a*) and 14(*b*), also in an actual measurement result, compared with the case where the potential regulating plate 35 is absent, the potential of the intermediary transfer belt 6 is lowered in the case where the potential regulating plate 35 is present. As shown in FIG. 14(*a*), in the case where the potential regulating plate 35 was removed, the potential of the intermediary transfer belt 6 was increased after the intermediary transfer belt 6 passed through the driving roller 20, and the potential of the transfer belt 15 was increased after the transfer belt 15 passed through the attraction roller 33.

As a result, a potential difference ΔV of not less than 3000 V was generated between the intermediary transfer belt 6 and the transfer belt 15 on an upstream side of the secondary transfer portion T2, so that a strong electric field was generated before the secondary transfer portion T2. By this electric field, a carrying force for carrying the unfixed toner image on the intermediary transfer belt 6 was lowered, so that the toner image was disturbed before the secondary transfer.

As shown in FIG. 14(*b*), in the case where the potential regulating plate 35 was attached, the transfer belt 15 was increased in potential after being spaced from the attraction roller 33 but the intermediary transfer belt 6 was not increased in potential after being spaced from the driving roller 20. As a result, the large potential difference ΔV formed between the intermediary transfer belt 6 and the transfer belt 15 was eliminated, so that the strong electric field such that the toner image was disturbed before the secondary transfer was not observed.

In both of the case where the potential regulating plate 35 was present and the case where the potential regulating plate 35 was absent, continuous image formation was effected under the same condition as that in Embodiment 1, so that the occurrence frequency of each of scattering and the abnormal electric charge image was compared similarly as in Embodiment 1. An evaluation result is shown in Table 2.

TABLE 2

| PRP *1 | Scattering *2 | Image *3 |
|---|---|---|
| PRESENCE | ○ | ○ |
| ABSENCE | X | X |

*1: "PRP" represents the potential regulating plate.
*2: "Scattering" represents toner scattering (pre-transfer of toner image before secondary transfer).
*3: "Image" represents the abnormal electric discharge image.

As shown in Table 2, in Embodiment 2, by providing the potential regulating plate 35, the degrees of the abnormal image and scattering generated on the upstream side of the secondary transfer portion T2 are decreased compared with those in the case where the potential regulating plate 35 is not provided. This is because in the case where the potential regulating plate 36 is present, the potential of the transfer belt 15 on the upstream side of the secondary transfer portion T2 can be lowered and therefore the electric field, which disturbs the toner image on the intermediary transfer belt 6, in front of the secondary transfer portion T2 can be alleviated.

Incidentally, as the potential regulating plate 35 is brought near to the intermediary transfer belt 6, the capacity C2 of the air gap capacitor formed between the potential regulating plate 35 and the intermediary transfer belt 6 becomes large, so that the potential of the intermediary transfer belt 6 can be lowered and the potential difference ΔV is small and stabilized. Further, when the potential regulating plate 35 contacts the intermediary transfer belt 6, only the gap formed by tolerances of surface smoothness of the potential regulating plate 35 and smoothness of the intermediary transfer belt 6 is formed and thus the contact state is more desirable. For that reason, in Embodiment 2, the potential regulating plate 35 was contacted to the intermediary transfer belt 6.

Also in Embodiment 2, the electric field which disturbs the toner image on the intermediary transfer belt 6 in front of the secondary transfer portion T2 can be remarkably alleviated and it is possible to prevent the abnormal image and scattering generated in front of the secondary transfer portion T2.

Embodiment 3

Figure 15:
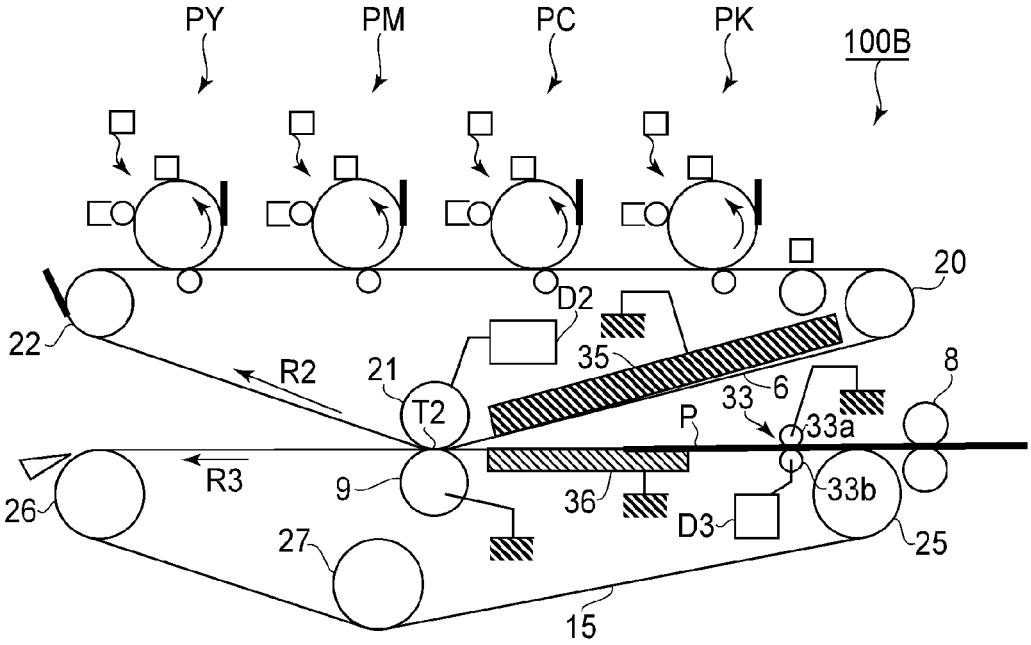
FIG. 15 is an illustration of a structure of an image forming apparatus in Embodiment 3.
Figure 16:
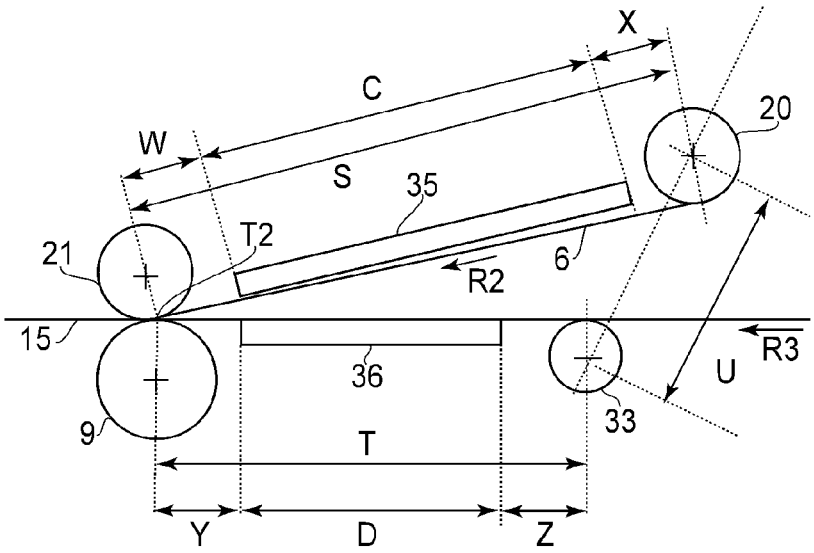
FIG. 16 is an illustration of electrode arrangement on an upstream side of a secondary transfer portion in Embodiment 3.
Figure 17:
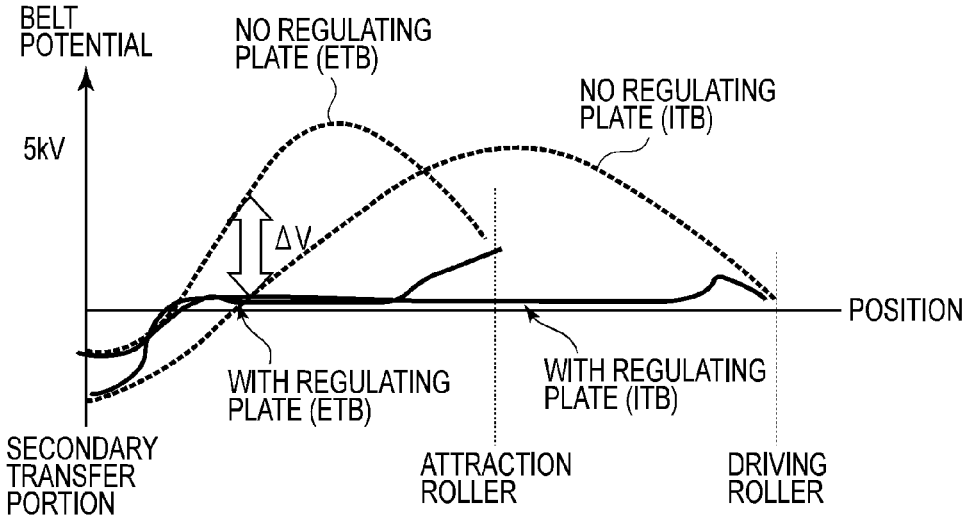
FIG. 17 is an illustration of an effect of a potential regulating plate.
Figure 18:
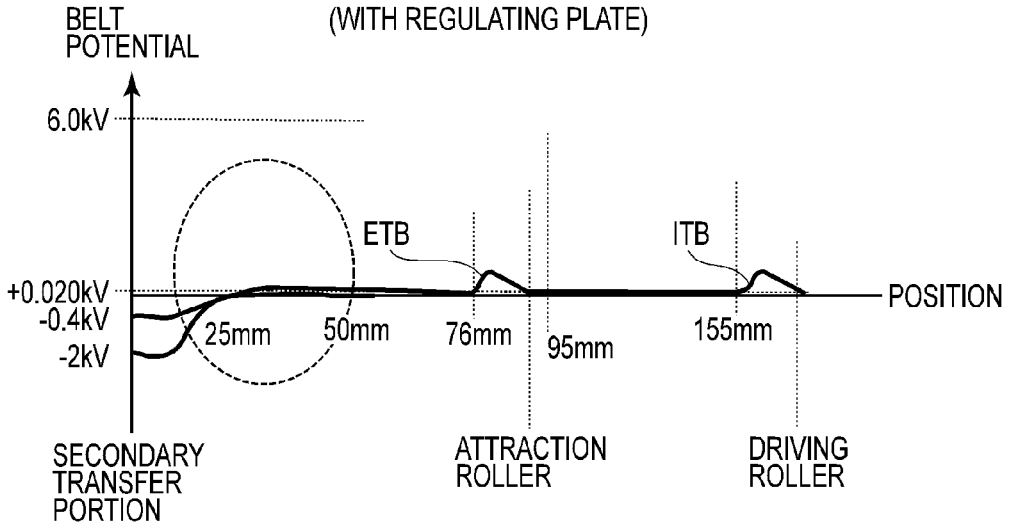
FIG. 18 is an illustration of a comparison result of potential measurement with the potential regulating plate.

FIG. 15 is an illustration of a structure of the image forming apparatus in Embodiment 3. FIGS. 16(*a*) and 16(*b*) are illustrations of electrode arrangement on an upstream side of a secondary transfer portion in Embodiment 3. FIG. 17 is an illustration of an effect of a potential regulating plate. FIGS. 18(*a*) and 18(*b*) are illustrations of a comparison result of potential measurement when the potential regulating plate is absent and present, respectively.

An image forming apparatus 100B in this embodiment is constituted by adding the potential regulating plate 35 of the image forming apparatus 100A shown in FIG. 10 into the image forming apparatus 100 shown in FIG. 1. Other constitutions are equal to those in Embodiment 1, and the constitution and arrangement of the potential regulating plate 35 are equal to those in Embodiment 2. Therefore, in FIG. 15, constituent members common to those in FIGS. 1 and 10 are represented by the same reference numerals or symbols and will be omitted from redundant description.

As shown in FIG. 15, in this embodiment, the potential regulating plate 36 which was the grounded sheet-like electrode was disposed on the inner surface of the transfer belt 15 between the attraction roller 33 and the secondary transfer portion T2. Further, on the inner surface of the intermediary transfer belt 6 between the driving roller 20 and the opposite roller 21, the potential regulating plate 35 which was the grounded sheet-like electrode was disposed.

To the attraction roller 33, the voltage which is constant current-controlled at +15 μA to +30 μA is applied by the power source D3 when the recording material P supplied to the transfer belt 15 is nip-conveyed. As a result, the recording material P is electrostatically attracted to the transfer belt 15. The transfer belt 15 is rotated in the arrow R3 direction and sends the recording material P to the secondary transfer portion T2. At that time, the power source D2 applies to the opposite roller 21 the voltage which is constant current-controlled at −30 μA to −40 μA, so that the toner image is secondary-transferred from the intermediary transfer belt 6 onto the recording material P.

As shown in FIG. 16, the arrangement of the opposite roller 21 and the driving roller 20, the outer diameter of the driving roller 20, and the size and arrangement of the potential regulating plate 35 are as described in Embodiment 2 with reference to FIGS. 11(*a*) and 11(*b*). The arrangement of the secondary transfer roller 9 and the attraction roller 33 and the size and arrangement of the potential regulating plate 35 are as described in Embodiment 1 with reference to FIGS. 6(*a*) and 6(*b*). Incidentally, in this embodiment, the length C of the potential regulating plate 35 with respect to the movement direction of the intermediary transfer belt 6 is larger than the length D of the potential regulating plate 36 with respect to the movement direction of the transfer belt 15.

As shown in FIG. 17 by broken lines, in the case where the potential regulating plates 35 and 36 were removed, the potential of the intermediary transfer belt 6 was increased after the intermediary transfer belt 6 passed through the driving roller 20, and the potential of the transfer belt 15 was increased after the transfer belt 15 passed through the attraction roller 33.

As a result, a potential difference ΔV exceeding 4000 V was generated between the intermediary transfer belt 6 and the transfer belt 15 on an upstream side of the secondary transfer portion T2, so that an electric field was generated before the secondary transfer portion T2 in a direction in which the negatively charged toner image was attracted to the transfer belt 15. By this electric field, a carrying force for carrying the toner image on the intermediary transfer belt 6 was lowered, so that a transfer image was disturbed in front of the secondary transfer portion T2.

As shown in FIG. 17 by solid lines, in the case where the potential regulating plates 35 and 36 were attached, the intermediary transfer belt 6 and the transfer belt 15 were not increased in potential, so that the large potential difference ΔV generated on the upstream side of the secondary transfer portion T2 was eliminated. The potentials of the intermediary transfer belt 6 and the transfer belt 15 were able to be lowered and the electric field which disturbs the toner image on the intermediary transfer belt 6 on the upstream side of the secondary transfer portion T2 was able to be remarkably alleviated.

In both of the case where the potential regulating plates 35 and 36 were present and the case where the potential regulating plate 36 was absent, continuous image formation was effected under the same condition as in Embodiment 1, so that the occurrence frequency of each of the scattering and the abnormal electric charge image was compared similarly as in Embodiment 1. An evaluation result is shown in Table 3.

TABLE 3

| PRP *1 | Scattering *2 | Image *3 |
|---|---|---|
| PRESENCE | ◎ | ○ |
| ABSENCE | X | X |

*1: "PRP" represents the potential regulating plate.
*2: "Scattering" represents toner scattering (pre-transfer of toner image before secondary transfer).
*3: "Image" represents the abnormal electric discharge image.

As shown in Table 3, in Embodiment 3, by providing the potential regulating plates 35 and 36, the degrees of the abnormal image and scattering generated on the upstream side of the secondary transfer portion T2 are further decreased compared with those in the case where one of the potential regulating plates 35 and 36 were provided. As shown in FIG. 18, it was confirmed that also in the actual measurement result, in the case where the potential regulating plates 35 and 36 were present, both of the potentials of the intermediary transfer belt 6 and the transfer belt 15 on the upstream side of the secondary transfer portion T2 were able to be lowered. As a result, the electric field, which disturbed the toner image on the intermediary transfer belt 6, in front of the secondary transfer portion T2 was able to be alleviated.

According to Embodiment 3, the electric field which disturbs the toner image on the intermediary transfer belt 6 in front of the secondary transfer portion T2 can be remarkably alleviated and it is possible to obtain the abnormal image and scattering generated on the upstream side of the secondary transfer portion T2.

Embodiment 4

Figure 19:
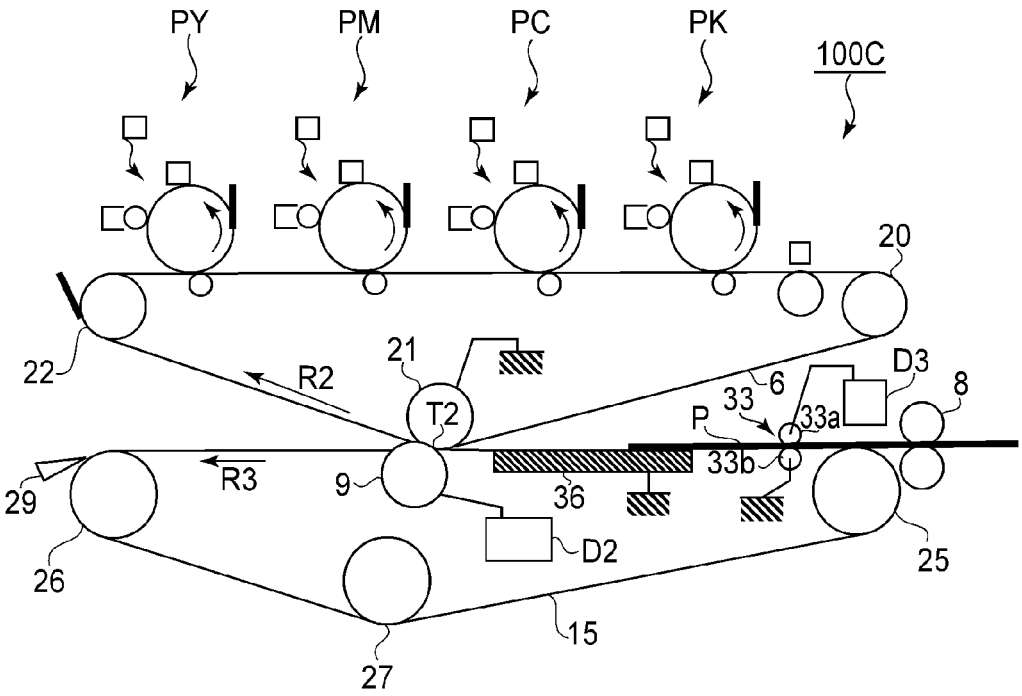
FIG. 19 is an illustration of a structure of an image forming apparatus in Embodiment 4.
Figure 20:
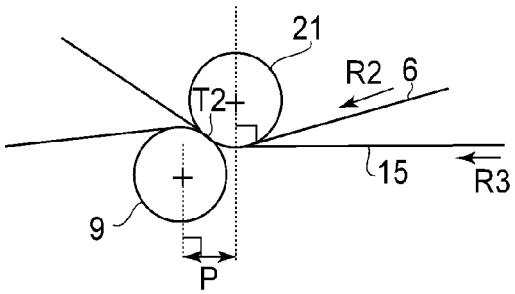
FIG. 20 is an illustration of roller arrangement on an upstream side of a secondary transfer portion in Embodiment 4.
Figure 21:
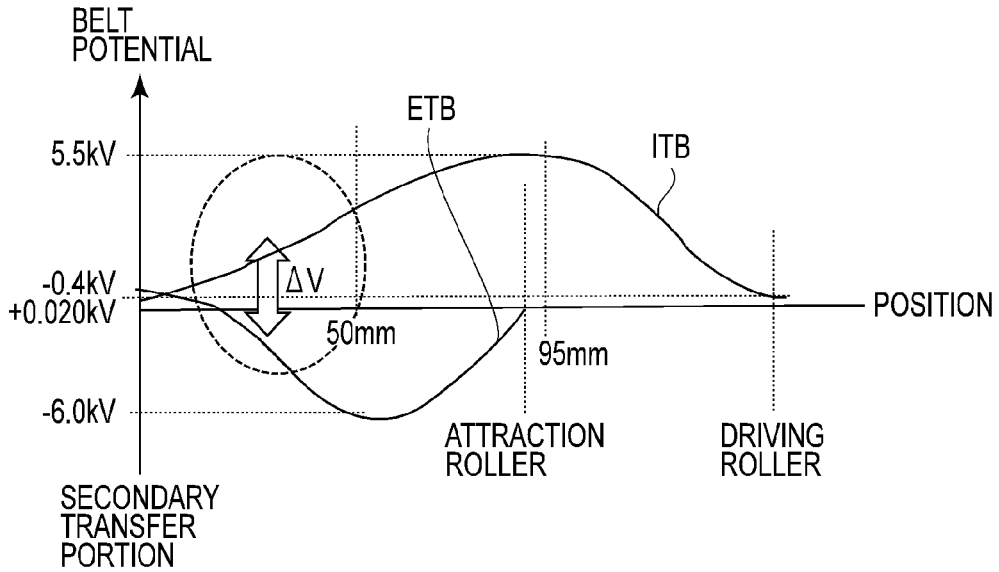
FIGS. 21(*a*) and 21(*b*) are illustrations of comparison results of potential measurement with no potential regulating plate and with the potential regulating plate, respectively.
Figure 21:
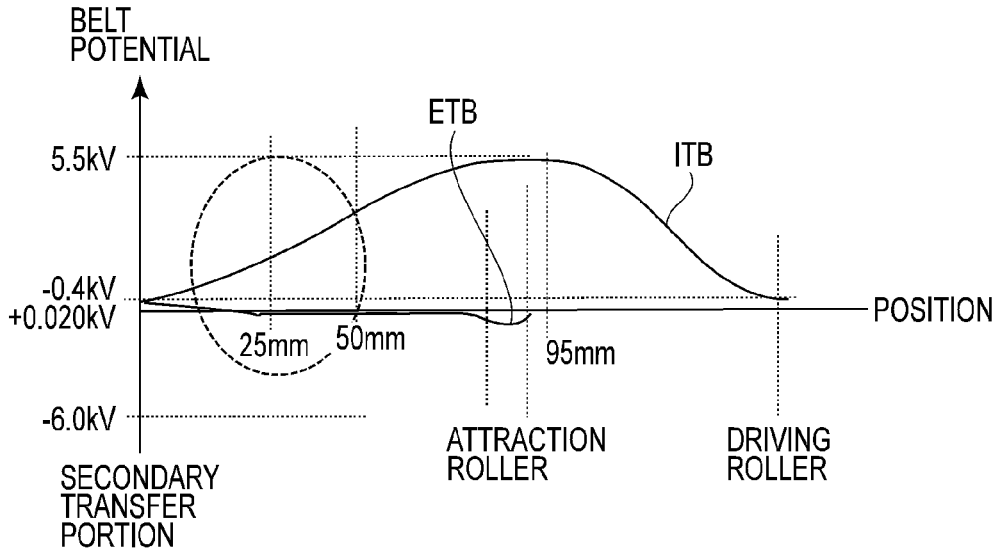

FIG. 19 is an illustration of a structure of the image forming apparatus in Embodiment 4. FIG. 20 is an illustration of roller arrangement at a secondary transfer portion in Embodiment 4. FIGS. 21(*a*) and 21(*b*) are illustrations of a comparison result of potential measurement when the potential regulating plate is absent and present, respectively.

In an image forming apparatus 100C in this embodiment, the voltage applying method at the secondary transfer portion T2 and the voltage applying method with respect to the attraction roller 33 are equal to those in Embodiment 2 but the roller arrangement at the secondary transfer portion T2 is different from that in Embodiment 1. Other constitutions are equal to those in Embodiment 2 and therefore, in FIG. 19, constituent members common to those shown in FIGS. 1 and 10 are represented by common reference numerals or symbols and will be omitted from redundant description.

As shown in FIG. 19, in this embodiment, the attraction roller 33 is constituted by the roller 33*a* connected to the power source D3 and the roller 33*b* connected to the ground potential. As described in Embodiment 2, the power source D3 applies a DC voltage, which is constant current-controlled at −15 μA to −30 μA, to the roller 33*a* contacted to the outer surface of the transfer belt 15. As a result, the recording material P is negatively charged, so that the recording material P is electrostatically attracted to the surface of the transfer belt 15.

The opposite roller 21 is connected to the ground potential, and the secondary transfer roller 9 is connected to the power source D2. When the transfer belt 15 carrying the recording material P passes through the secondary transfer portion T2, the power source D2 applies to the secondary transfer roller 9 the DC voltage, which is constant current-controlled at, e.g., +30 μA to +40 μA, of a (positive) polarity opposite to the charge polarity of the toner image. As a result, the toner image carried on the intermediary transfer belt 6 is secondary-transferred onto the recording material P.

In Embodiment 4, the potential regulating plate 36 which is connected to the ground potential and is a sheet-like electrode member was provided so as to contact the transfer belt 15 at a position in which the transfer belt 15 passed through the attraction roller 33 but did not pass through the secondary transfer roller 9. Incidentally, in the case where the potential regulating plate 36 is disposed in non-contact with the transfer belt 15, a distance between the potential regulating plate 36 and the transfer belt 15 may be 1 mm to 5 mm.

As shown in FIG. 20, in this embodiment, the secondary transfer roller 9, is offset-disposed, with respect to the opposite roller 21, toward the downstream side of the opposite roller 21 with respect to the rotational direction of the transfer belt 15, and an offset amount (distance) P is 4 mm. As a result, the opposite roller 21 connected to the ground potential performs the function similar to that of the potential regulating plate 35 in Embodiment 2, so that the potential difference ΔV between the transfer belt 15 and the intermediary transfer belt 6 on the upstream side of the secondary transfer portion T1 can be alleviated.

As shown in FIGS. 6(*a*) and 6(*b*), the sizes and disposition relationships among the opposite roller 21, the driving roller 20, the attraction roller 33 and the potential regulating plate 36 were set similarly as in Embodiment 1.

As shown in FIG. 21(*a*), in the case where the potential regulating plate 36 was removed, the potential of the intermediary transfer belt 6 was increased after the intermediary transfer belt 6 passed through the driving roller 20, and the potential of the transfer belt 15 was increased after the transfer belt 15 passed through the attraction roller 33.

As a result, a potential difference ΔV exceeding 3000 V was generated between the intermediary transfer belt 6 and the transfer belt 15 on an upstream side of the secondary transfer portion T2, so that a strong electric field was generated before the secondary transfer portion T2. By this electric field, a carrying force for carrying the unfixed toner image on the intermediary transfer belt 6 was lowered, so that the toner image was disturbed before the secondary transfer.

As shown in FIG. 21(*b*), in the case where the potential regulating plate 36 is attached, the transfer belt 15 is not increased in potential after being spaced from the attraction roller 33 similarly as in Embodiment 1. In addition, the opposite roller 21 connected to the ground potential forms the air gap capacitor on the upstream side of the secondary transfer portion T2 to lower the voltage of the intermediary transfer belt 6.

That is, as shown in FIG. 13(*b*), when the intermediary transfer belt 6 reaches the upstream side of the secondary transfer portion T2, to the intermediary transfer belt 6, the capacitor Cb with the capacity C2 formed between the opposite roller 21 and the intermediary transfer belt 6 is connected. As a result, even when the charge Q of the charged intermediary transfer belt 6 is constant, the potential of the intermediary transfer belt 6 is lowered. For this reason, even when the potential regulating plate 35 as in Embodiment 3 is not disposed, it is possible to obtain an effect close to the effect in Embodiment 3. As a result, the large potential difference ΔV formed between the intermediary transfer belt 6 and the transfer belt 15 was eliminated, so that the strong electric field such that the toner image was disturbed before the secondary transfer was not observed.

In both of the case where the potential regulating plate 36 was present and the case where the potential regulating plate 36 was absent, continuous image formation was effected under the same condition as that in Embodiment 1, so that the occurrence frequency of each of scattering and the abnormal electric charge image was compared similarly as in Embodiment 1. An evaluation result is shown in Table 4.

TABLE 4

| PRP *1 | Scattering *2 | Image *3 |
|---|---|---|
| PRESENCE | ◎ | ○ |
| ABSENCE | X | X |

*1: "PRP" represents the potential regulating plate.
*2: "Scattering" represents toner scattering (pre-transfer of toner image before secondary transfer).
*3: "Image" represents the abnormal electric discharge image.

As shown in Table 4, in Embodiment 4, the degrees of the abnormal image and scattering generated on the upstream side of the secondary transfer portion T2 are decreased comparably to those in the case where both of the potential regulating plates 35 and 36 are provided.

In Embodiment 4, the secondary transfer roller 9 is disposed toward the downstream side with respect to the opposite roller 21 so as to enlarge a control area between the opposite roller 21 and the intermediary transfer belt 6 on the upstream side of the secondary transfer portion T2. By offsetting the secondary transfer roller 9 toward the downstream side, the opposite roller 21 can be utilized in place of the potential regulating plate 35 disposed on the inner surface of the intermediary transfer belt 6 in Embodiment 3.

As a result, the electric field which disturbs the toner image on the intermediary transfer belt 6 on the upstream side of the secondary transfer portion T2 can be remarkably alleviated and it is possible to prevent the abnormal image and scattering generated on the upstream side of the secondary transfer portion T2.

Incidentally, such as embodiment that the potential regulating plate 35 is disposed on the inner surface of the intermediary transfer belt 6 as in Embodiment 2 and the secondary transfer roller 9 is disposed, instead of the provision of the potential regulating plate 36, offset toward the upstream side of the secondary transfer portion T2 would also be considered. However, in this case, on the upstream side of the secondary transfer portion T2, the electric field of the transfer voltage is formed and thus the transfer starts before the secondary transfer portion T2, so that the scattering image is undesirably formed.

Embodiment 5

Figure 22:
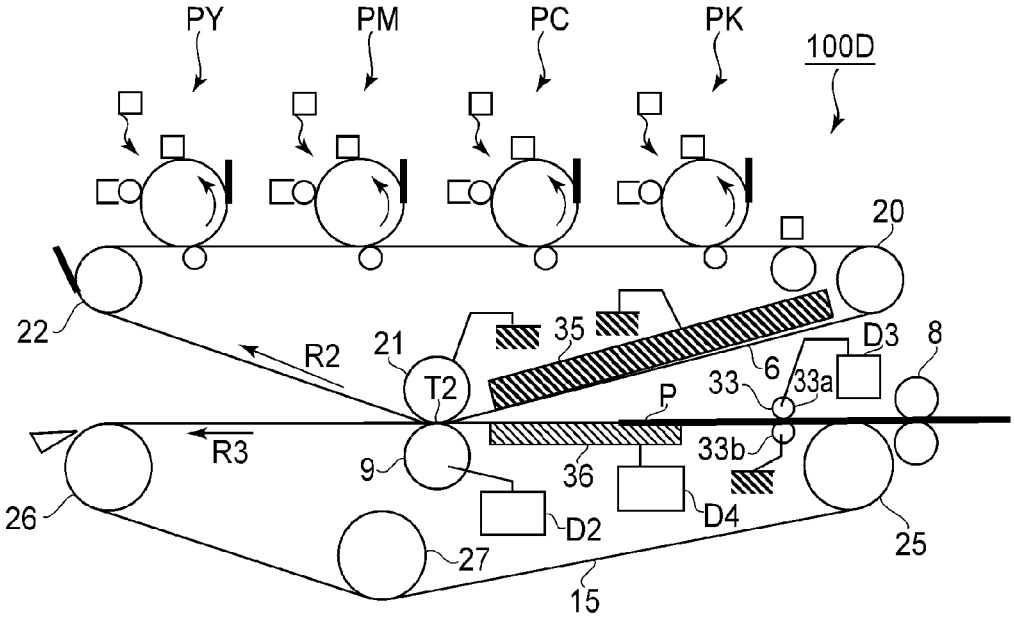
FIG. 22 is an illustration of a structure of an image forming apparatus in Embodiment 5.
Figure 23:
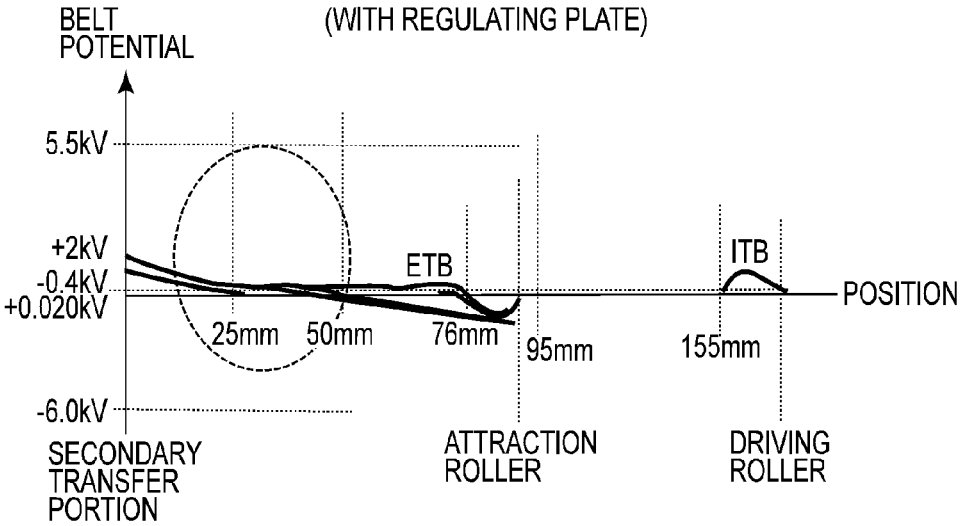
FIG. 23 is an illustration of a comparison result of potential measurement with the potential regulating plate.

FIG. 22 is an illustration of a structure of the image forming apparatus in Embodiment 5. FIG. 23 is an illustration of a comparison result of potential measurement when the potential regulating plate is present.

In an image forming apparatus 100D in this embodiment, the voltage applying method at the secondary transfer portion T2 and the voltage applying method with respect to the attraction roller 33 are equal to those in Embodiment 2 and the arrangement of the potential regulating plates 35 and 36 is equal to that in Embodiment 3. Further, the potential regulating plate 35 is connected to the power source D in place of the ground potential. Other constitutions are equal to those in Embodiment 2 and therefore, in FIG. 20, constituent members common to those shown in FIGS. 1 and 15 are represented by common reference numerals or symbols and will be omitted from redundant description.

As shown in FIG. 22, in this embodiment, the attraction roller 33 is constituted by the roller 33*a* connected to the power source D3 and the roller 33*b* connected to the ground potential. The power source D3 applies a DC voltage, which is constant current-controlled at −15 μA to −30 μA, to the roller 33*a* contacted to the outer surface of the transfer belt 15. As a result, the recording material P is negatively charged, so that the recording material P is electrostatically attracted to the surface of the transfer belt 15.

The opposite roller 21 is connected to the ground potential, and the secondary transfer roller 9 is connected to the power source D2. When the transfer belt 15 carrying the recording material P passes through the secondary transfer portion T2, the power source D2 applies to the secondary transfer roller 9 the DC voltage, which is constant current-controlled at, e.g., +30 μA to +40 μA, of a (positive) polarity opposite to the charge polarity of the toner image. As a result, the toner image carried on the intermediary transfer belt 6 is secondary-transferred onto the recording material P.

In this embodiment, similarly as in Embodiment 2, on the inner surface of the intermediary transfer belt 6 between the driving roller 20 and the opposite roller 21, the potential regulating plate 35 which was the grounded sheet-like electrode was disposed. However, the potential regulating plate 36 which is the sheet-like electrode disposed on the inner surface of the transfer belt 15 between the attraction roller 33 and the secondary transfer portion T2 is not grounded but is connected to the power source D4. To the power source D4, the DC voltage of +10 V to +100 V is applied.

As shown in FIG. 16, the arrangement of the opposite roller 21 and the driving roller 20, the outer diameter of the driving roller 20, and the size and arrangement of the potential regulating plate 35 are as described in Embodiment 2 with reference to FIGS. 11(*a*) and 11(*b*). The arrangement of the secondary transfer roller 9 and the attraction roller 33 and the size and arrangement of the potential regulating plate 35 are as described in Embodiment 1 with reference to FIGS. 6(*a*) and 6(*b*).

As shown in FIG. 14(*a*), in the case where the potential regulating plates 35 and 36 were removed, the potential of the intermediary transfer belt 6 was increased after the intermediary transfer belt 6 passed through the driving roller 20, and the potential of the transfer belt 15 was increased after the transfer belt 15 passed through the attraction roller 33.

As a result, a large potential difference ΔV was generated between the intermediary transfer belt 6 and the transfer belt 15 on an upstream side of the secondary transfer portion T2, so that a strong electric field was generated before the secondary transfer portion T2. By this electric field, a carrying force for carrying the unfixed toner image on the intermediary transfer belt 6 was lowered, so that the toner image was disturbed before the secondary transfer portion T2.

As shown in FIG. 23, in the case where the potential regulating plates 35 and 36 were attached and subjected to actual potential measurement, the intermediary transfer belt 6 and the transfer belt 15 were not increased in potential, so that the large potential difference ΔV generated on the upstream side of the secondary transfer portion T2 was eliminated. The potentials of the intermediary transfer belt 6 and the transfer belt 15 were lowered and the electric field which disturbs the toner image on the intermediary transfer belt 6 on the upstream side of the secondary transfer portion T2 was remarkably alleviated.

In both of the case where the potential regulating plates 35 and 36 were present and the case where the potential regulating plate 36 was absent, continuous image formation was effected under the same condition as in Embodiment 1, so that the occurrence frequency of each of the scattering and the abnormal electric charge image was compared similarly as in Embodiment 1. An evaluation result is shown in Table 5.

TABLE 5

| PRP *1 | Scattering *2 | Image *3 |
|---|---|---|
| PRESENCE | ◎ | ○ |
| ABSENCE | X | X |

*1: "PRP" represents the potential regulating plate.
*2: "Scattering" represents toner scattering (pre-transfer of toner image before secondary transfer).
*3: "Image" represents the abnormal electric discharge image.

As shown in Table 5, in Embodiment 5, by providing the potential regulating plates 35 and 36, the degrees of the abnormal image and scattering generated on the upstream side of the secondary transfer portion T2 are further decreased.

Further, as shown in FIG. 23, the voltage is applied to the potential regulating plate 36, so that the potential of the transfer belt 15 can be forcedly regulated compared with the case where the voltage is not applied to the potential regulating plate 36. Even when the gap is formed between the potential regulating plate 36 and the transfer belt 15 by tolerances of smoothness of the surface of the potential regulating plate 36 and smoothness of the transfer belt 15, the potential of the transfer belt 15 can be regulated stably.

Incidentally, in Embodiment 5, the voltage is applied to only the potential regulating plate 36 but the voltage may also be applied to the potential regulating plate 35.

In Embodiment 5, the voltage can be applied to the potential regulating plate 36, so that the potentials of the intermediary transfer belt 6 and the transfer belt 15 on the upstream side of the secondary transfer portion T2 can be set at desired levels. As a result, the potential difference between the intermediary transfer belt 6 and the transfer belt 15 on the upstream side of the secondary transfer portion T2 can be stabilized. For this reason, the electric field which disturbs the toner image on the intermediary transfer belt 6 before the secondary transfer portion T2 can be remarkably alleviated, so that the image free from the abnormal image can be outputted.

As described above, in the image forming apparatus of the present invention, the capacitor is formed, through the transfer belt, between the sheet-like first electrode member and the recording material on the upstream side of the secondary transfer portion, so that the surface potential of the recording material is lowered even when the electric charges possessed by the recording material and the transfer belt are equal to each other. For this reason, even when the potential of the intermediary transfer belt side is not changed, the potential difference between the intermediary transfer belt side and the image bearing member side becomes small at the time when the recording material enters the transfer portion, so that the electric discharge and the scattering are less caused to occur.

Therefore, the potential of the recording material which is carried on the transfer belt and enters the transfer portion can be stably controlled, so that the high-quality image suppressed in electric discharge and scattering can be stably outputted.

Here, in the case where the sheet-like second electrode member is disposed on the inner surface of the intermediary transfer belt, the second electrode member and the recording material forms the capacitor before the secondary transfer portion through the intermediary transfer belt. For this reason, even when the electric charges possessed by the toner image and the intermediary transfer belt are equal to each other, the surface potential of the toner image is lowered, so that the potential difference between the toner image and the recording material is further decreased and stabilized at the time when the recording material enters the transfer portion and thus the electric discharge and the scattering are further less caused to occur.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 264312/2009 filed Nov. 19, 2009, which is hereby incorporated by reference.

What is claimed is:

1. An image forming apparatus comprising:

an image bearing member;

an image forming unit configured to form a toner image on said image bearing member;

an intermediary transfer belt configured to carry the toner image transferred from said image bearing member;

a recording material transfer belt configured to carry and convey a recording material;

an attraction portion configured to electrostatically attract the recording material to said recording material transfer belt, wherein at a position of said attraction portion, said recording material transfer belt and said intermediary transfer belt oppose each other in a mutually spaced state;

a transfer portion configured to transfer the toner image from said intermediary transfer belt onto the recording material attracted by said attraction portion to said recording material transfer belt, and configured to be disposed downstream of a contact start position, with respect to a movement direction of said recording material transfer belt, where contact between said recording material transfer belt and said intermediary transfer belt starts; and a potential regulating plate configured to suppress an increase in potential of said recording material transfer belt and configured to be surface-contacted to an inner surface of said recording material transfer belt downstream of said attraction portion and upstream of the contact start position with respect to the movement direction of said recording material transfer belt.

2. An image forming apparatus according to claim 1, further comprising a second potential regulating plate disposed in an area, upstream of the contact start position with respect to a movement direction of said intermediary transfer belt, in which said second potential regulating plate opposes said recording material transfer belt through said intermediary transfer belt, said second potential regulating plate being contacted to an inner surface of said intermediary transfer belt.

3. An image forming apparatus according to claim 2, wherein said potential regulating plate has a dimension with respect to the movement direction of said recording material transfer belt that is shorter than that of said second potential regulating plate with respect to the movement direction of said intermediary transfer belt.

4. An image forming apparatus according to claim 1, wherein said potential regulating plate is grounded.

5. An image forming apparatus according to claim 1, wherein a dimension of said potential regulating plate with respect to a width direction perpendicular to the movement direction of said recording material transfer belt is longer than a dimension of the recording material having a passable maximum size with respect to the width direction and is shorter than a dimension of said recording material transfer belt with respect to the width direction.

6. An image forming apparatus according to claim 2, wherein a dimension of said second potential regulating plate with respect to a width direction perpendicular to the movement direction of said intermediary transfer belt is longer than a dimension of the recording material having a passable maximum size with respect to the width direction and is shorter than a dimension of said intermediary transfer belt with respect to the width direction.

7. An image forming apparatus according to claim 1, wherein a dimension of said attraction portion with respect to a width direction perpendicular to the movement direction of said recording material transfer belt is longer than a dimension of said recording material transfer belt with respect to the width direction.

8. An image forming apparatus according to claim 1, wherein said transfer portion includes a first transfer member contacted to an inner surface of said intermediary transfer belt and includes a second transfer member which is contacted to the inner surface of said recording material transfer belt and to which a voltage is applied, and wherein a voltage of an identical polarity as the voltage applied to the second transfer member is applied to said potential regulating plate.

9. An image forming apparatus according to claim 1, wherein said transfer portion includes a first transfer member contacted to an inner surface of said intermediary transfer belt and includes a second transfer member contacted to the inner surface of said recording material transfer belt, wherein said potential regulating plate and the second transfer member are grounded, and wherein a transfer voltage for transferring the toner image from said intermediary transfer belt onto the recording material at said transfer portion is applied to the first transfer member.

10. An image forming apparatus according to claim 1, wherein said transfer portion includes a first transfer member contacted to an inner surface of said intermediary transfer belt and includes a second transfer member contacted to the inner surface of said recording material transfer belt, and wherein the first transfer member is located upstream of the second transfer member with respect to a conveyance direction of the recording material.

11. An image forming apparatus according to claim 2, wherein said second potential regulating plate has a plate shape.

* * * * *